US005717818A

United States Patent [19]

Nejime et al.

[11] Patent Number: 5,717,818

[45] Date of Patent: Feb. 10, 1998

[54] AUDIO SIGNAL STORING APPARATUS HAVING A FUNCTION FOR CONVERTING SPEECH SPEED

[75] Inventors: Yoshito Nejime, Hachioji; Yukio Kumagai, Tokorozawa; Tadashi Takamiya, Nakaminato; Yasunori Kawauchi, Mito; Nobuo Hataoka, Kanagawa-ken; Juichi Morikawa, Katsuta, all of Japan

[73] Assignee: Hitachi, Ltd., Tokyo, Japan

[21] Appl. No.: 301,994

[22] Filed: Sep. 9, 1994

Related U.S. Application Data

[63] Continuation-in-part of Ser. No. 931,375, Aug. 18, 1992, abandoned.

[30] Foreign Application Priority Data

| | | | |
|---|---|---|---|
| Sep. 10, 1993 | [JP] | Japan | 5-225449 |
| Jul. 19, 1994 | [JP] | Japan | 6-167232 |

[51] Int. Cl.[6] ..... G10L 3/02

[52] U.S. Cl. ..... 395/2.2; 395/2.16; 395/2.8; 381/23.1; 381/68

[58] Field of Search ..... 395/2.2, 2.23, 395/2.24, 2.17, 2.67, 2.8, 2.76, 2.87, 2.16; 381/34–40, 51, 68.2, 68, 23.1, 68.4

[56] References Cited

U.S. PATENT DOCUMENTS

| | | | |
|---|---|---|---|
| 3,681,756 | 8/1972 | Burkhard et al. | 395/2.14 |
| 3,816,664 | 6/1974 | Koch | 395/2.2 |
| 4,624,012 | 11/1986 | Lin et al. | 381/51 |
| 4,890,325 | 12/1989 | Taniguchi et al. | 381/34 |
| 4,910,780 | 3/1990 | Miki | 381/32 |
| 5,276,739 | 1/1994 | Krokstad et al. | 381/68.2 |
| 5,305,420 | 4/1994 | Nakamura et al. | 395/2.17 |
| 5,341,432 | 8/1994 | Suzuki et al. | 395/2.25 |

FOREIGN PATENT DOCUMENTS

| | | | |
|---|---|---|---|
| 0204629 | 6/1986 | European Pat. Off. | G09B 5/04 |
| 4227826 | 8/1992 | Germany | G10L 5/02 |
| 179599 | 7/1989 | Japan | H04R 25/04 |
| 0294832 | 4/1990 | Japan | H04B 14/04 |
| 9108654 | 6/1991 | WIPO | H04R 25/00 |

OTHER PUBLICATIONS

Journal of Acoustical Society of Japan, "Application of Digital Tech. to Compensation for Hearing Impairment", vol. 47, No. 10, pp. 760–765, 1991.

"Speech Perception Aids for Hearing Impaired People: Current Status and Needed Research", J. Acoust. Soc. Am. 90(2), pt. 1 Aug. 1991, pp. 637–685.

Technical Report of Institute of Electronics Info. and Comm. Engs., "A Development of Portable DSP System for Speech Processing to Air Senior's Hearing", by Nejime et al, vol. 92, #207, SP92–54, Sep. 1992.

(List continued on next page.)

*Primary Examiner*—Kee M. Tung

*Attorney, Agent, or Firm*—Antonelli, Terry, Stout & Kraus, LLP

[57] ABSTRACT

The speed of an input speech is changed without any change of the pitch of the input speech. Raw data of a speech are stored so that the speed of the speech can be modulated continuously on the basis of the raw data of the speech. In the speech speed conversion method, a speech speed conversion process for the input speech is carried out in a period designated when speech speed conversion is needed, which the speech speed conversion is not carried out in the other period. Further, in the speech speed conversion apparatus having a unit for inputting a speech, a speech speed conversion unit for changing the speed of the input speech, and a unit for supplying the output of the speech speed conversion unit as an output speech to listener's ears, the apparatus further includes a speech speed conversion switch, and a unit for outputting a speech while changing the speech speed of the input speech in a period in which the speech speed conversion switch is turned on, but for outputting a speech without any change of the input speech in the other period in which the speech speed conversion switch is turned off.

34 Claims, 28 Drawing Sheets

OTHER PUBLICATIONS

Technical Report of Inst. of Elect. Info. and Comm. Engs. "Realtime Voice Speed Converting System Without Impairment in Quality", vol. 92, No. 207, by Nakamura et al.

"The Topics of Hearing Aid", Journal of the Acoustical Society of Japan, vol. 45, No. 7, 1989, pp. 549–555.

"Digital Hearing Aid Emphasizing Speech Characteristics", Journal of the Acoustical Society of Japan, vol. 43, No. 5, 1987, pp. 356–361.

IEEE 1992 Int'l Conference on Consumer Electronics, Jun. 2–4, 1992, R. Suzuki et al., "Time–Scale Modification of Speech Signals Using Cross–Correlation", pp. 166–167.

AUDIO SIGNAL STORING APPARATUS HAVING A FUNCTION FOR CONVERTING SPEECH SPEED

This application is a Continuation-In-Part of application Ser. No. 07/931,375, filed on Aug. 18, 1992, abandoned.

BACKGROUND OF THE INVENTION

The present invention relates to a speech speed conversion method, a speech speed conversion apparatus, and an electronic apparatus for modulating the speed of a voice, and, particularly, to a technique which is effective on application to a control technique for using such an apparatus in conversation and so on.

Conventional devices for aiding hearing for persons hard of hearing mainly have used analog type hearing aids which use analog circuits for processing the amplitude and frequency characteristic of a voice. On the contrary, research and development for using digital signal processing to compensate for hearing-impairment have been made eagerly in recent years. The trend of this research and development has been described in detail, for example, in "Application of Digital Technique to Compensation for Hearing-Impairment", Journal of Acoustical Society of Japan (Vol. 47, No. 10, pp. 760–765, 1991) and "Speech-perception aids for hearing-impaired people: Current status and needed research", J. Acoust. Soc. Am. (90(2), Pt. 1, Aug. 1991).

To compensate for hearing loss, amplification of the amplitude of a speech signal and compression of dynamic range are generally performed with every frequency in accordance with the hearing characteristic of a user. In the conventional analog hearing aid, such a process is realized by an analog circuit. On the other hand, in the digital hearing aid developed in recent years, this process is realized by a software such as a digital filter, or the like, so that adaptation to the hearing characteristic of the user can be made more in detail.

In the aforementioned trend, an attempt to change only the speed of a voice by digital signal processing without any change of the pitch of the voice to thereby perform hearing aids of higher degree covering the whole range of a hearing system inclusive of the decline of language processing speed has been made in recent years. Such a speech speed conversion technique has been described in detail, for example, in "Development of Portable DSP System for performing Speech Processing for the Aged", Technical Research Report of Institute of Electronics, Information and Communication Engineers of Japan (Vol. 92, No. 207 SP92-54) and "High-Quality Real-Time Speech Speed Conversion System", ditto (SP92-55).

In the aforementioned conventional techniques, a broadcasted voice over the television/radio or the like, or a voice recorded in a tape recorder or the like, was used as the voice to be subjected to speech speed conversion. That is, the subject of speech speed conversion was only a voice one-sidedly given to a listener.

Taking into account the fact that the conventional hearing aids can be used without distinction of the input voice in kind, it is however preferable that the speech speed conversion apparatus also can use other voices than the aforementioned voices as the input voice. Particularly, if the voice of a talker in conversation can be heard slowly, the apparatus can be used not only in the case of hearing perception aids for aged or hearing-impaired people but also in the case of hearing aids in conversation of a foreign language unfamiliar to hearing-unhandicapped people, and so on.

SUMMARY OF THE INVENTION

An object of the present invention is to provide a technique for reproducing speech while converting the speed of the speech if needed.

Another object of the present invention is to provide a technique in which raw data of a speech are stored so that the speed of the speech can be converted continuously on the basis of the raw data of the speech.

A further object of the present invention is to provide an apparatus control unit for using a speech speed conversion apparatus in conversation, or the like.

A further object of the present invention is to provide a technique capable of widening the range of application of the speech speed conversion apparatus.

A further object of the present invention is to provide a technique capable of using a memory of the speech speed conversion apparatus effectively.

A further object of the present invention is to provide a technique capable of returning a reading pointer of the memory of the speech speed conversion apparatus.

A further object of the present invention is to provide a technique capable of controlling an AV apparatus connected to the speech speed conversion apparatus.

A further object of the present invention is to provide a technique capable of performing continuous speech speed conversion in the speech speed conversion apparatus.

A further object of the present invention is to provide a technique capable of attaining improvement in handling property of the speech speed conversion apparatus.

A further object of the present invention is to provide a technique capable of reducing electric power consumed by the speech speed conversion apparatus.

The foregoing and other objects and novel features of the present invention will become clear from the description in this specification and the accompanying drawings.

A summary of typical embodiments of the present invention disclosed in this application will be described in brief as follows.

(1) A speech speed conversion method for receiving an input speech and changing the speed of the input speech without changing the pitch of the input speech comprises the steps of: carrying out a speech speed conversion process for the input speech in a period which is designated by a listener when speech speed conversion is needed; and carrying out no speech speed conversion process in the other period than the designated period.

(2) A speech speed conversion apparatus comprises: means for receiving an input speech; a speech speed conversion means for changing the speed of the input speech; means for supplying an output of the speech speed conversion means as a speech output to a listener's ears; a speech speed conversion switch apparatus; and means adapted to output a speech while changing the speech speed of the input speech in a period in which the speech speed conversion switch is turned on, and to output an output speech without any change of the speech speed of the input speech in the other period in which the speech speed conversion switch is turned off.

(3) A speech speed conversion method for encoding and accumulating a raw speech, reading the accumulated encoded speech and changing the speed of the speech without any change of the pitch of the raw speech, which comprises the steps of: carrying out a speech speed conversion process for an input speech in a period which is designated when speech speed conversion is needed;

and carrying out no speech speed conversion process in the other period than the designated period.

(4) A speech speed conversion apparatus which comprises: means for receiving a raw speech as an input speech; a memory means for encoding and accumulating the input speech; a speech speed conversion means for reading the accumulated encoded-speech and for changing the speed of the input speech; means for supplying an output of the speech speed conversion means as a speech output to a listener's ears; a speech speed conversion switch; and means adapted to output a speech while changing the speech speed of the input speech in a period in which the speech speed conversion switch is turned on, and to output an output speech without any change of the speech speed of the input speech in the other period in Which the speech speed conversion switch is turned off.

(5) In the speech speed conversion apparatus, the memory means includes means for storing data by frame.

(6) The speech speed conversion apparatus further comprises means for determining waveform expansion/reduction processes in the speech speed conversion process on the basis of a comparison between power of a frame and a threshold provided as a variable.

(7) The speech speed conversion apparatus further comprises a speech speed selection switch for selecting the speed of the speech, and means for changing the speed of the speech to the speech speed selected by the speech speed selection switch.

(8) The speed conversion apparatus further comprises means (AV control) for controlling an audio/video apparatus.

(9) The speed conversion apparatus further comprises a repeat switch, and means for repeating a reproduced speech in a period in which the repeat switch is turned on.

(10) In the speech speed conversion apparatus, the repeat means includes at least one of means for turning back the speech by several seconds whenever the repeat switch is pushed once, means for sometimes generating intermittent sounds while the speech is turned back, means for stopping the turning-back of the speech when the speech reaches an end of a ring buffer, and means for selecting the speech speed at the repeat time.

(11) In the speech speed conversion apparatus, the means for selecting the speech speed at the repeat time has at least two modes of default speed value repeat, slow repeat, fast repeat and gradually accelerated repeat.

(12) The speech speed conversion apparatus further comprises a catching-up means for adjusting the quantity of a lag from the real time in a period in which the stored information is reproduced in the case where the lag from the real time is caused by a speech speed conversion or repeat operation.

(13) In the speech speed conversion apparatus, the catching-up means includes at least one of means for starting catching-up when a slow reproduction mode is terminated, means for starting catching-up when reproduction is turned back to the point of time of the start of a repeat after the repeat, means for selecting the speech speed at the catching-up time, means for automatically shifting the current mode to a through mode for directly outputting the input speech when catching-up is completed, and means for generating a report signal sound (message) when catching-up is completed.

(14) In the speech speed conversion apparatus, the means for selecting the speech speed at the catching-up time has at least one of means for making a nonstop skip to the real time, means for catching up the real time with fast hearing, and means for making a parallel movement with a time lag.

(15) The speech speed conversion apparatus further comprises at least one of the speech speed conversion switch, a speech speed selection switch, a repeat switch, and a reset switch which are provided in a peripheral portion on a side surface of the speech speed conversion apparatus so as to facilitate handling.

(16) In the speech speed conversion apparatus, the reset switch includes means for stopping the repeating or catching-up operation and making a skip to the real time when the switch is turned on at the repeat or catching-up time, and then shifting the current mode to a through mode.

(17) In the speech speed conversion apparatus, the speech speed conversion means is provided as a software executed by a digital signal processor having an input terminal for receiving an interruption request signal from the outside, so that controlling of the speech speed conversion process or switching of the rate of speech speed conversion on the basis of the speech speed conversion switch is given to the digital signal processor via the interruption request signal input terminal.

(18) The speech speed conversion apparatus further comprises means for hearing the output speech through a binaural headphone.

(19) A speech speed conversion apparatus which comprises: a microphone for converting an acoustic signal into an electric signal; an analog amplifier for amplifying an output of the microphone; a low-pass filter for removing high-frequency components from the output of the analog amplifier; an A/D converter for converting an output of the low-pass filter, which is an analog signal, into a digital signal; a digital signal processor for carrying out digital signal processing to execute a speech speed changing process; a memory means for holding input speech data and data obtained as a result of signal processing; means for controlling the speech speed changing process executed by the digital signal processor; means for changing a processing parameter; a D/A converter for converting digital speech data into an analog value; a second low-pass filter for removing high-frequency components from an output of the D/A converter; a second analog amplifier for amplifying an output of the second low-pass filter; and a headphone for converting an output of the second analog amplifier into an acoustic signal and supplying the acoustic signal to both ears.

(20) A speech speed conversion apparatus which comprises: a microphone for converting an acoustic signal into an electric signal; an analog amplifier for amplifying an output of the microphone; a low-pass filter for removing high-frequency components from an output of the analog amplifier; an A/D converter for converting an output of the low-pass filter, which is an analog signal, into a digital signal; a memory means for holding input speech data and data obtained as a result of signal processing; a digital signal processor for reading accumulated information and carrying out digital signal processing to execute a speech speed changing process; means for controlling the speech speed changing process executed by the digital signal processor; means for changing a processing parameter; a D/A converter for converting digital speech data into an analog value; a second low-pass filter for removing high-frequency components from an output of the D/A converter; a second analog amplifier for amplifying an output of the second low-pass filter; and a headphone for converting an output of the second analog amplifier into an acoustic signal and supplying the acoustic signal to both ears.

(21) In the speech speed conversion apparatus, the speech speed conversion means carries out a series of procedure over a whole frame repeatedly through a pipeline process by frame with use of a plurality of input frame buffers, the series of procedure including: applying a pitch extraction process to a leading portion of the frame to detect the pitch of the leading portion; transferring data of the length of one pitch thus detected to output buffers; multiplying data of the length of two pitches by a window function which changes from 0 to 1 and by a window function which changes from 1 to 0; adding up respective data obtained by the multiplications by the window functions to thereby generate a reproduced wave pattern having a time length of two pitches; inserting the reproduced wave pattern in the rear of the preliminarily transferred data of the length of one pitch; carrying out a pitch detection process again while spearheaded by a position at a distance of two pitches from the position preliminarily subjected to the pitch extraction process to thereby perform pitch detection at the position; and transferring data of the length of n pitches (n is an integer) based on the pitch length obtained by the final pitch detection to the output buffers.

(22) A speech speed conversion apparatus wherein the speech speed conversion means is executed only in the case where average power of data in an input frame is higher than a preliminarily set threshold, which data contained in the frame are directly transferred to the output buffers in the case where the average power is lower than the threshold.

(23) In the speech speed conversion apparatus, a second threshold is provided in the threshold process for the average power of data in the input frame so that when a frame having lower average power than the second threshold is continued for a longer time than a preliminarily set time threshold, data in the frame having lower average power than the second threshold and continued for a longer time than the time threshold are forbidden to be transferred to the output buffers.

(24) In the speech speed conversion apparatus, the switch or each of the switches is constituted by a switch which has a feeling of soft touch so that the microphone does not pick up click noise of the switch.

(25) In the speech speed conversion apparatus, the switches have respective surface forms different in tactility so as to be identified without seeing.

(26) The speech speed conversion apparatus further comprises a rustling prevention means for changing a distance between the microphone and an apparatus body so that the microphone does not touch clothes directly when the apparatus body is put into a breast pocket in use.

(27) The speech speed conversion apparatus further comprises a display means which is provided at a predetermined position of the speech speed conversion apparatus so that a quantity of a time lag from the real time can be indicated visually.

(28) In the speech speed conversion apparatus, a ring buffer is used as the memory means, and the apparatus further comprises means for managing a lag time by a counter indicating a time lag on the ring buffer.

(29) In the speech speed conversion apparatus, a standby mode for lowering the clock cycle of the processor and carrying out the same process as in the through mode is provided besides the through mode.

(30) The speech speed conversion apparatus further comprises an electric source switch operated at three stages consisting of an ON stage, an OFF stage and an ON-OFF intermediate stage, and an electric source supply means operated in an analog through mode in which analog input-output systems are short-circuited so as to be directly connected to each other to thereby stop electric source supply to a digital processing system between the analog input-output systems when the switch is adjusted to the intermediate stage.

(31) A telephone in which the speech speed conversion means as defined in any one of the above paragraphs (2), (4) and (30) is provided between a handset of the telephone and a body of the telephone.

(32) A telephone line switching system in which the speech speed conversion means as defined in any one of the above paragraphs (2), (4) and (30) is provided in a telephone line switching system.

According to the feature described in the above paragraphs (1) and (2), in the case where a speech is inputted and the speed of the speech is changed without any change of the pitch of the input speech, a speech speed conversion process is carried out for the input speech in a period which is designated when speech speed conversion is needed, but no speech speed conversion is carried out in the other period. Accordingly, the speech speed conversion apparatus can be used not only for a voice such as a radio voice one-sidedly given to a listener but also in the situation of conversation, so that a voice to be subjected to speech speed conversion can be selected by the listener without any disturbance of listener's own speech.

Further, in a hearing aid, a foreign language learning machine, a telephone, or the like, talker's voice can be heard at a slow speech speed without any change of the characteristic of the talker's voice.

According to the feature described in the above paragraphs (3) and (4), in the case where a raw speech encoded and accumulated is read to change the speed of the speech without any change of the pitch of the raw speech, or the like, a speech speed conversion process is carried out for the input speech in a period which is designated when speech speed conversion is needed, but no speech speed conversion is carried out in the other period. Accordingly, in addition to the effect provided by the paragraphs (1) and (2), there can be provided effective use of the memory, a raw speech repeat function, a voice memory function, a repeat speech speed conversion function, a fast-hearing reproduction function, and so on.

According to the feature described in the above paragraph (5), data are stored by frame, so that writing/reading efficiency can be improved.

According to the feature described in the above paragraph (6), the determination of waveform expansion/reduction process, silent-part elimination process, etc. in the speech speed conversion process is performed based on comparison between power of a frame and a threshold, and the threshold is changed in accordance with the loudness of the input speech. Accordingly, the speech speed conversion process can be carried out in accordance with the environmental condition in use.

According to the feature described in the above paragraph (7), in the speech speed conversion apparatus, there are provided a speech speed selection switch for selecting the speed of the speech, and means for changing the speed of the speech to the speech speed selected by the speech speed selection switch. Accordingly, the speed of the speech to be heard can be selected by the listener's own will.

According to the feature described in the above paragraph (8), means (AV control) for controlling an audio/video apparatus is provided in the speech speed conversion apparatus. Accordingly, a series of operation in which a signal for pausing the reproducing operation of the external apparatus is issued to temporarily stop the inputting of the speech to the speech speed conversion apparatus when the memory capacity is insufficient and in which the outputting of the pause signal is stopped to re-start the inputting of the speech from the external apparatus when there is some free area in the memory, is repeated irrespective of the expansion/reduction rate in the speech speed conversion. As a result, use of speech speed conversion can be continued for a long time.

According to the feature described in the above paragraphs (9) to (11), in the speech speed conversion apparatus, there are provided a repeat switch and means for repeating a reproduced speech in a period in which the repeat switch is turned on. Accordingly, the speech speed conversion of the repeat speech can be carried out.

According to the feature described in the above paragraphs (12) to (14), a catching-up means for catching up the speech to a position of stored information to be heard is provided in the speech speed conversion apparatus. Accordingly, widening of the range of application of the speech speed conversion apparatus, reduction in operating time, improvement in handling property, and so on, can be attained.

According to the feature described in the above paragraphs (15) and (16), at least one of the speech speed conversion switch, speech speed selection switch, repeat switch and reset switch is provided in a peripheral portion on a side surface of the speech speed conversion apparatus so as to perform handling easily. Accordingly, widening of the range of application of the speech speed conversion apparatus, reduction in operating time, improvement in handling property, and so on, can be attained.

According to the feature described in the above paragraphs (17) to (23), the speech speed conversion means is provided as a software executed by a digital signal processor having an input terminal for receiving an interruption request signal from the outside, so that controlling of the speech speed conversion process or switching of the speech speed conversion rate on the basis of the speech speed conversion switch is given to the digital signal processor via the interruption request signal input terminal.

Further, the aforementioned speech speed conversion means carries out a series of procedure over a whole frame repeatedly through a pipe-line process by frame with use of a plurality of input frame buffers, the series of procedure including: applying a pitch extraction process to a leading portion of the frame to detect the pitch of the leading portion; transferring data of the length of one pitch thus detected to output buffers; multiplying data of the length of two pitches by a window function which changes from 0 to 1 and by a window function which changes from 1 to 0; adding up respective data obtained by the multiplications by the window functions to thereby generate a reproduced wave pattern having a time length of two pitches; inserting the reproduced wave pattern in the rear of the preliminarily transferred data of the length of one pitch; carrying out a pitch detection process again while spearheaded by a position at a distance of two pitches from the position preliminarily subjected to the pitch extraction process to thereby perform pitch detection at the position; and transferring data of the length of n pitches (n is an integer) based on the pitch length obtained by the final pitch detection to the output buffers.

Further, the speech speed conversion means is executed only in the case where average power of data in an input frame is higher than a preliminarily set threshold, which data contained in the frame are directly transferred to the output buffers in the case where the average power is lower than the threshold.

Further, a second threshold is provided in the threshold process for the average power of data in the input frame so that when a frame having lower average power than the second threshold is continued for a longer time than a preliminarily set time threshold, data in the frame having lower average power than the second threshold and continued for a longer time than the time threshold are forbidden to be transferred to the output buffers.

By the aforementioned configuration of the speech speed conversion means, there can be attained improvement in speech speed conversion efficiency and prevention of lowering of the quality of the reproduced speech.

According to the feature described in the above paragraph (24), the microphone does not pick up click noise of each switch, so that loud noise at the time of the manipulation of the switch can be prevented.

According to the feature described in the above paragraph (25), the switches have respective surface formed different in tactility so as to be identified without seeing, so that handling property can be improved.

According to the feature described in the above paragraph (26), there is provided means for preventing the rustle of clothes in contact with the microphone, so that entrance of noise can be reduced.

According to the feature described in the above paragraph (27), a display means is provided at a predetermined position of the speech speed conversion apparatus so that the quantity of a time lag from the real time can be indicated visually. Accordingly, reduction in operating time, improvement in handling property, and so on, can be attained.

According to the feature described in the above paragraph (28), a ring buffer is used as the memory means, and there is provided means for managing a lag time by a counter indicating a time lag on the ring buffer. Accordingly, the repeat process, the catching-up process, and so on, can be carried out easily.

According to the feature described in the above paragraph (29), a standby mode is provided besides the through mode, so that reduction in consumed electric power can be attained.

According to the feature described in the above paragraph (30), there is provided an electric source switch operated in three stages consisting of an ON stage, an OFF stage and an ON-OFF intermediate stage so that an analog through mode is provided. Accordingly, reduction in electric power can be attained.

According to the feature described in the above paragraph (31), the speech speed conversion means is provided between a handset of a telephone and a body of the telephone. Accordingly, a speech to be subjected to speech speed conversion can be selected by the listener without any disturbance of the listener's own speech.

Further, in the telephone, the voice can be heard at a slow speech speed without any change of the characteristic of the talker's voice.

According to the feature described in the above paragraph (32), the speech speed conversion means is provided in a telephone line switching system. Accordingly, the voice to be subjected to speech speed conversion can be selected by the listener without any disturbance of the listener's own speech.

Sill further advantages of the present invention will become apparent to those of ordinary skill in the art upon reading and understanding the following detailed description of the preferred and alternate embodiments.

DESCRIPTION OF THE PREFERRED EMBODIMENTS

Figure 1:
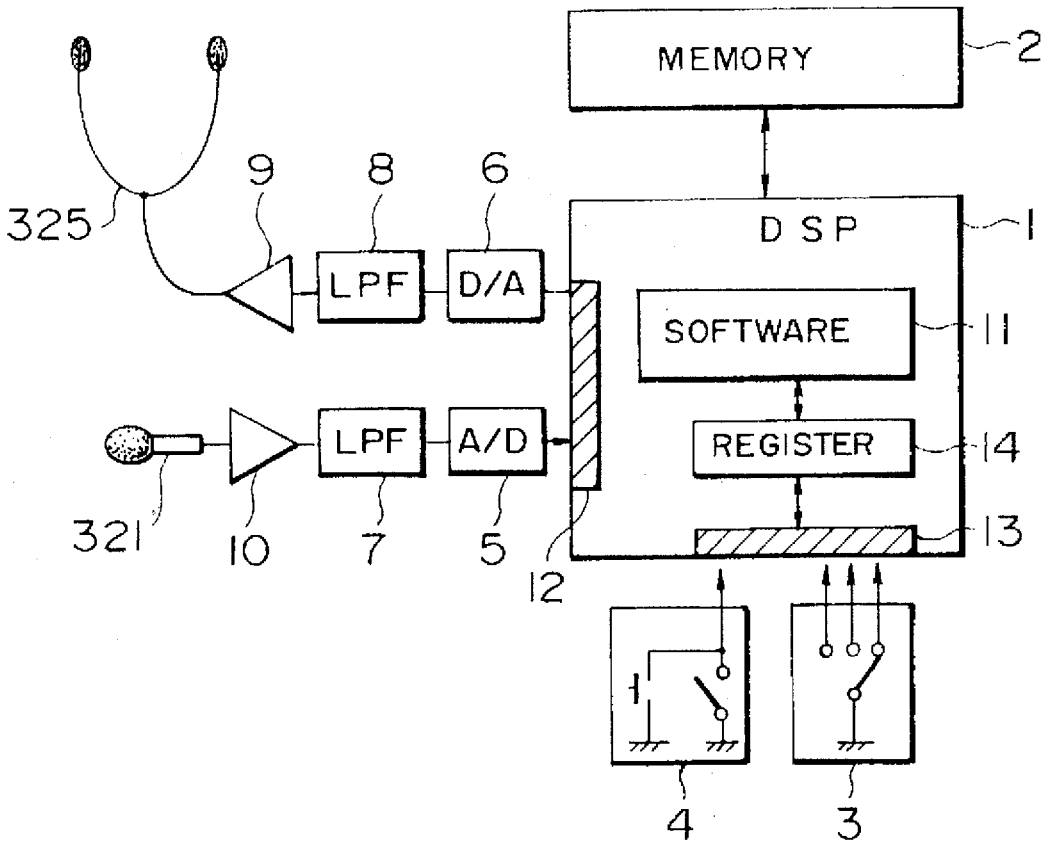
FIG. 1 is a block diagram showing the schematic structure of internal circuits according to present invention.

Embodiments of the present invention are described below in detail with reference to the drawings.

In the drawings for explaining the embodiments, parts having the same function are marked by the same reference character to omit the repeated description thereof.

FIG. 1 is a block diagram showing the schematic structure of internal circuits according to the present invention. The reference numeral 1 designates a DSP (Digital Signal Processor); 11, a software for performing a speech speed conversion process; 12, a serial port; 13, a terminal for external interruption flag; 14, a flag register; 2, a memory (output buffer); 3, a selector switch; 4, a PTL (Push-To-Listen) switch; 5, an A/D converter; 6, a D/A converter; 7, a low-pass filter; 8, a low-pass filter; 9, an analog amplifier; 10, an analog amplifier; 321, a microphone; and 325, a binaural headphone (earphone).

In a speech speed conversion apparatus according to this embodiment, as shown in FIG. 1, a voice is inputted to the microphone 321 and outputted as a voice signal (an electric signal). This voice signal is inputted via the amplifier 10 and the low-pass filter 7 to the A/D converter 5, in which the voice signal is converted from an analog value into a digital value at intervals of a time set in advance.

The voice signal converted into a digital value as described above is inputted to the DSP 1. Then, the speech speed conversion process of the voice signal is realized by the software 11 on the DSP 1. The PTL switch 4 is connected to the external interruption flag terminal 13 contained in the DSP 1, so that the state of the PTL switch 4 is expressed as a numerical value of the flag register 14 which is provided in the inside of the DSP 1 so as to correspond to this terminal 13. In the software 11 on the DSP 1, a judgment in accordance with the numerical value of the flag register 14 is made as to whether the speech speed conversion process is to be performed or not to be performed.

The digital voice data subjected to the speech speed conversion process is stored in the output buffer memory 2. The D/A converter 6 converts the data of the output buffer memory 2 from a digital value into an analog value at intervals of a time set in advance. The analog signal obtained by this conversion is inputted via the low-pass filter 8 to the analog amplifier 9 and outputted as a voice from the binaural headphone 325 in a listener's favorite amplitude of speech signal.

In this embodiment, two kinds of switches are prepared for the PTL switch 4. One is a switch in which current conduction is made as long as a pushbutton is pushed. The other is a switch in which the current conduction state is maintained though the hold of the pushbutton is released. The former is used in the case of conversation whereas the latter is used in the case of continuous speech speed conversion of a one-sidedly given voice such as a radio voice which is conventional utilization, and the like. Further in this embodiment, the selector switch 3 as well as the PTL switch 4 is connected to the external interruption flag terminal 13 contained in the DSP 1. The numerical value of the flag register 14 is changed by the changeover of the selector switch 3, so that the software 11 changes the expansion rate of the speech speed conversion process in accordance with this numerical value.

Figure 2:
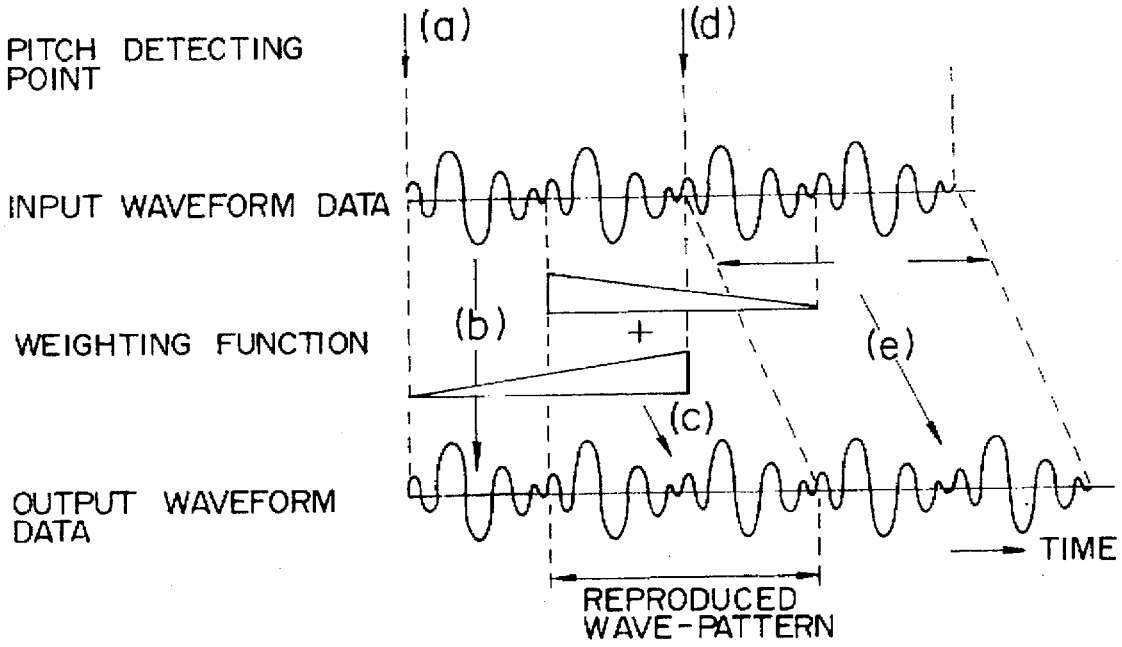
FIG. 2 is a graph for explaining a speech speed conversion process executed within a DSP according to present invention.

FIG. 2 is a view for explaining the speech speed conversion process which is performed in the DSP 1 in this embodiment. The speech speed conversion process in this embodiment is a method for detecting the pitch (basic period) of a voice signal and expanding the length of a waveform with the detected pitch as a unit, in which a voice data set of the order of tens of milliseconds (hereinafter referred to as "a frame") is made a unit for one process. Accordingly, at least two frame length input buffers are prepared in the inside of the DSP 1 so that while data from the A/D converter is inputted to one buffer, data stored in the other buffer is processed (pipe-line process). After being processed, data is stored in the output buffer 2 having a sufficiently large capacity. The procedure of processing data in each frame is as follows.

First of all, (a) a pitch extracting process (not shown) is applied to the head portion of the frame to thereby detect the pitch of this portion.

(b) Then, the thus detected data of the length of one pitch is transferred to the output buffer 2.

(c) Then, data of the length of two pitches is multiplied by a window function which changes from 0 to 1 and by a window function which changes from 1 to 0.

The on-data positions from which the multiplications by the window functions are started are however shifted by one pitch. Then, data as respective results of the multiplications by the window functions are added to each other to generate a reproduced wave pattern having the time length of two pitches and put the pattern in the rear of the one-pitch data which was transferred in advance.

(d) Then, a pitch detecting process (not shown) is carried out again in the condition in which a position two pitches away from the on-data position previously subjected to the pitch extracting process is at the head, so that pitch detection in this position is performed. Because the voice pitch generally always varies, a pitch different from the previously detected pitch is obtained in the second detection.

(e) Data of the length of n pitches is transferred to the output buffer with the pitch length obtained by this final pitch detection as a unit.

The aforementioned procedure of from (a) to (e) is repeated over the whole frame.

Because the pitch length depends on the input voice, the number of repeats in one frame is not constant. Further, different expansion rates are realized by changing the value of n in the aforementioned step (e). For example, data of the length of four pitches is generated from data of the length of three pitches in the input buffers in the condition of n=1, so that the expansion rate becomes 4/3=1.33 times. Similarly, the expansion rate becomes 1.50 times in the condition of n=0 and 1.25 times in the condition of n=2.

Figure 3:
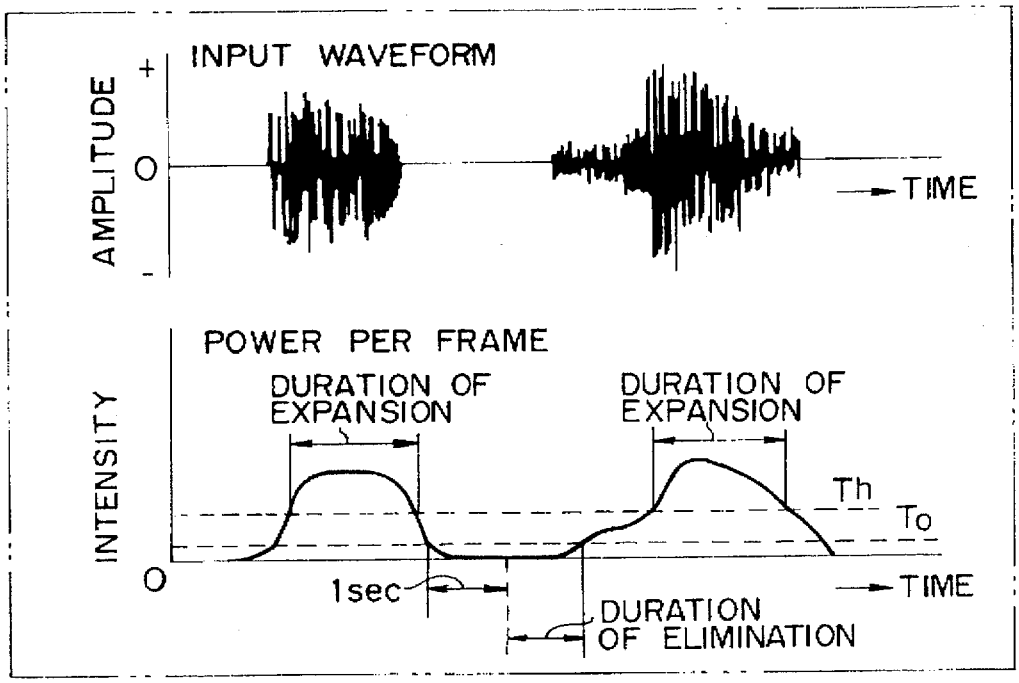
FIG. 3 is a graph for explaining the concept of a threshold process according to present invention.

Further, in this embodiment, the aforementioned speech speed conversion process in FIG. 2 is not always applied to all frames but the aforementioned process in FIG. 2 is applied only in the case where the calculated average power of each frame exceeds a threshold Th which was set in advance. Data in a frame having power not exceeding the threshold Th is therefore transferred to the output buffer in its original condition. FIG. 3 shows a concept of this threshold process.

In FIG. 3, the portion in which the power of each frame exceeds the threshold Th is expressed as a duration of expansion. Because the leading and trailing portions of the voice signal are not processed but outputted in their original condition by this threshold process, there is an advantage in that voice characteristic contained in the leading and trailing of the voice, for example, consonantal characteristic, is not destroyed.

Further, in this embodiment, a second threshold To is provided in the threshold process for the average power of each frame as shown in FIG. 3. In the case where a frame having power lower than this second threshold To is continued for a time not smaller than one second, the frame having power lower than the threshold To continuously for a time not smaller than one second is therefore processed so as not to be outputted. Accordingly, reduction in the quantity of data stored in the output buffer is attained.

In FIG. 3, this not-outputted portion is expressed as a duration of elimination. At the output buffer 2, data are one by one outputted to the D/A converter 6 at regular time intervals in parallel with the writing of the speech-speed-conversion-processed data at once each frame. Addresses in the output buffer 2 are set in the form of a ring so that the last address is continued to the first address.

Accordingly, in this ring-like address space, an operation is carried out so that an address pointer Po which points data to be fed to the D/A converter runs after an address pointer Pi which points the destination of the writing of the speech-speed-conversion-processed data. In this embodiment, Pi will overtake Po sooner or later because the speed of Pi is higher than the speed of Po. At this point of time, information which has been stored in the output buffer 2 is not outputted but rewritten.

Accordingly, the time from the start of the speech speed conversion operation to this state becomes a time length of the input voice which can be tackled by the speech speed conversion process of this embodiment. The reduction in the quantity of data based on the aforementioned threshold To has an effect that this time length which can be tackled is made long.

Further, the signal processing method in the speech speed conversion process explained above with reference to FIGS. 2 and 3 has been reported in "Evaluation of Speech Speed Conversion Method by Hearing-Impaired People" Technical Research Report of Institute of Electronics, Information and Communication Engineers of Japan, SP92-150 (1993-03) or "Discussion of Speech Speed Conversion Method using Portable DSP System" Proceedings of Acoustical Society of Japan (March 1993), 1-7-6.

Figure 4:
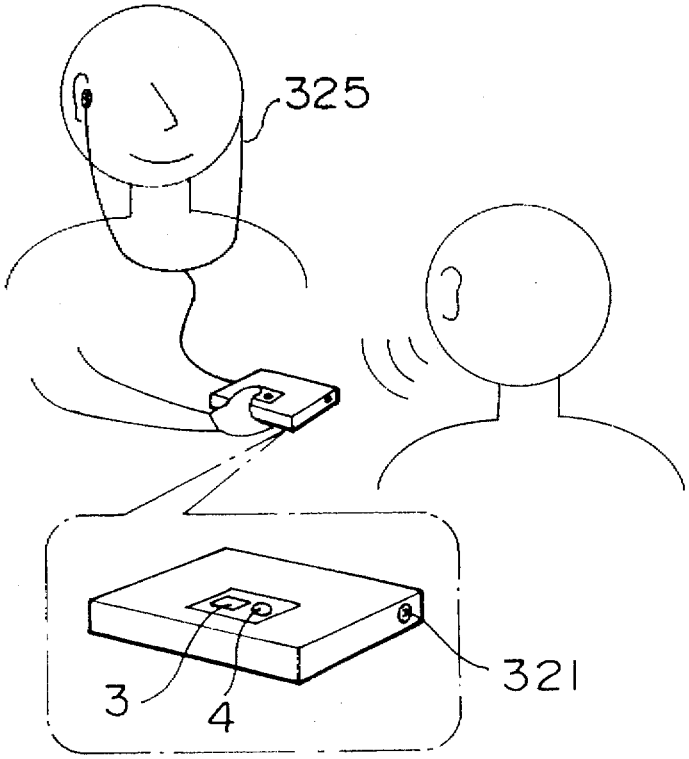
FIG. 4 is a view showing the form of use of the speech speed conversion apparatus according to present invention.

FIG. 4 is a view showing the form of use of the speech speed conversion apparatus according to this embodiment. Although FIG. 4 shows the case where the PTL switch 4 is disposed on the upper surface of the apparatus, it is a matter of course that the position of the arrangement thereof may be replaced by another position. On the other hand, the selector switch 3 for changing the expansion rate of speech speed conversion is prepared in a side of the PTL switch 4. Because the selector switch 3 as well as the PTL switch 4 is provided so that the state of the selector switch 3 can be observed through the external interruption flag terminal of the DSP 1 from the software on the DSP 1, the value of n in the aforementioned speech speed conversion process is changed in accordance with the state of the selector switch 3 when the PTL switch 4 is pushed. The expansion rate can be changed for every speech by operating the PTL switch 4 and the selector switch 3 alternately.

Figure 5:
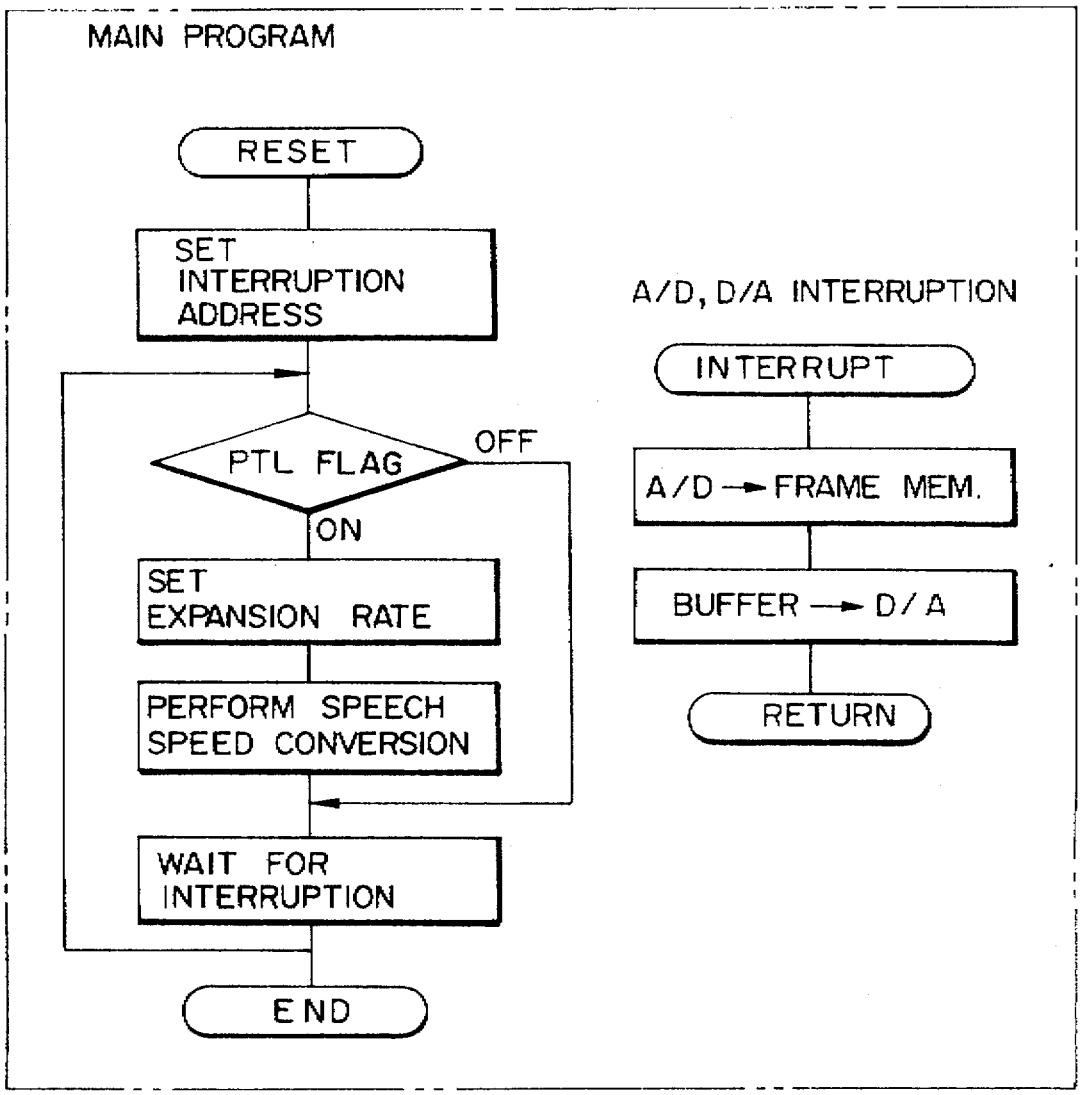
FIG. 5 is a flow chart showing the control procedure of the speech speed conversion apparatus according to present invention.

FIG. 5 shows the aforementioned control procedure expressed in a flow chart. In the speech speed conversion process, for example, a flame of the time length of the order of tens of milliseconds is used as a unit of processing. The A/D conversion and D/A conversion are processes which are carried out at regular intervals of a smaller time pitch than that, for example, at regular intervals of a time pitch of the order of, for example, tens of microseconds. As shown in FIG. 5, the A/D conversion, the D/A conversion and their attendant process are realized as an interruption process. While the speech speed conversion process and a process of waiting for interruption are carried out, the interruption process is carried out in accordance with an interruption signal from the serial port to which the A/D converter and the D/A converter are connected.

As is obvious from the above description, in accordance with this embodiment, the speech speed conversion apparatus can be used not only for the voice one-sidedly given to a listener like a radio broadcasting voice but also in the situation of conversation, so that the listener can select the voice subjected to the speech speed conversion without any disturbance of listener's own speech.

Further, the speech speed conversion apparatus of this embodiment can be used to compensate for the deterioration of voice hearing ability as observed in the aged or the like. It is further needless to say that the apparatus can be used even in the situation in which a listener who has no difficulty in hearing hears an unfamiliar foreign language.

Figure 6:
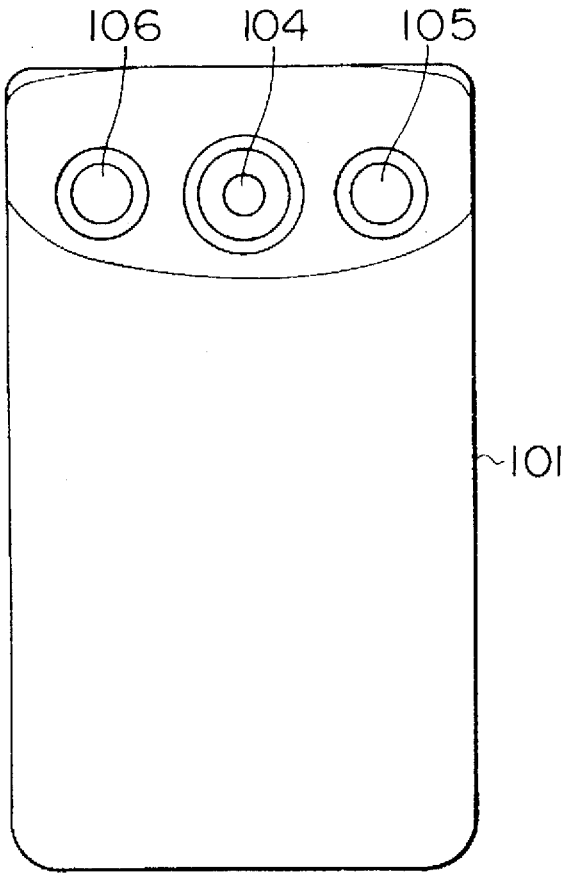
FIG. 6 is a front plan viewed from the front of the speech speed conversion apparatus according to present invention.
Figure 7:
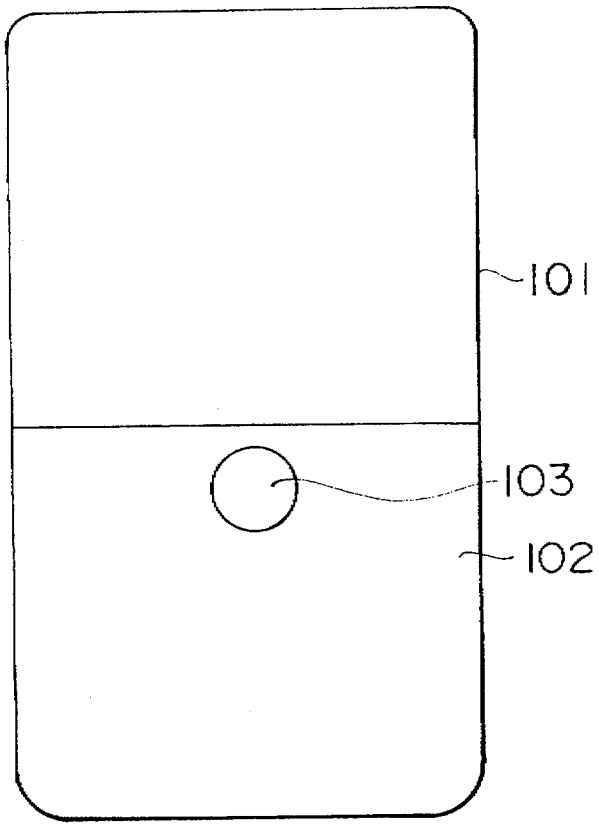
FIG. 7 is a back plan viewed from the back of the speech speed conversion apparatus according to present invention.
Figure 8:
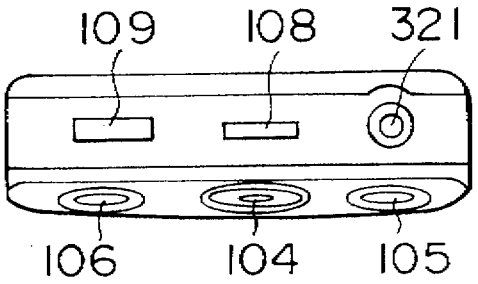
FIG. 8 is a top plan viewed from the top of the speech speed conversion apparatus according to present invention.
Figure 9:
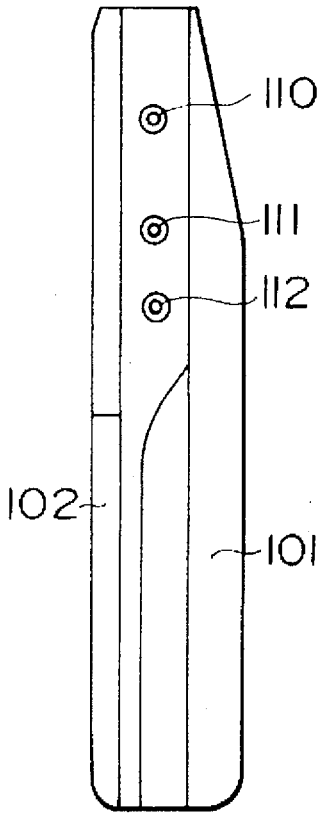
FIG. 9 is a left plan viewed from the left of the speech speed conversion apparatus according to present invention.
Figure 10:
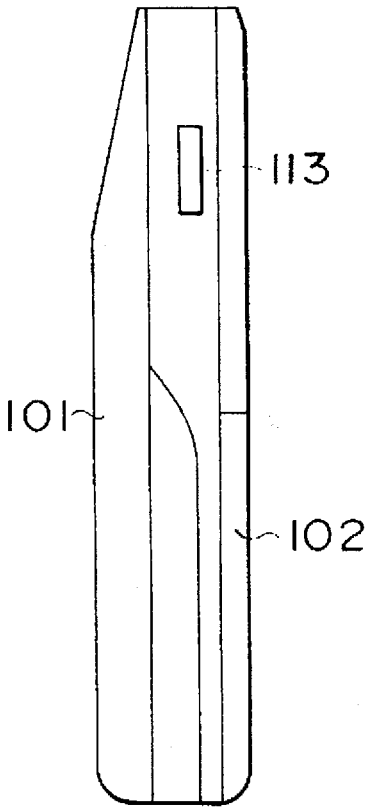
FIG. 10 is a right plan viewed from the right of the speech speed conversion apparatus according to present invention.

Referring to FIGS. 6 through 10, the external appearance structure of the speech speed conversion apparatus according to the present invention is shown in the following. FIG. 6 is a front plan view from the front; FIG. 7 is a back plan view from the back; FIG. 8 is a top plan view from the top; FIG. 9 is a left plan view from the left; and FIG. 10 is a right plan view from the right.

In FIGS. 6 to 10, the reference numeral 101 designates a body of the speech speed conversion apparatus; 102, a back cover; 103, a finger stop hollow; 104, a slow switch (slow pushbutton); 105, a repeat switch (repeat pushbutton); 106, a reset switch (reset pushbutton); 321, a microphone; 108, a voice volume; 109, an electric source switch; 110, an earphone terminal; 111, an external input terminal; 112, an AV control terminal; and 113, a speech speed changeover switch (speech speed setting switch).

As shown in FIGS. 6 to 10, in the speech speed conversion apparatus of this embodiment, the slow switch 104, the repeat switch 105 and the reset switch 106 are provided in positions where the body 101 of the speech speed conversion apparatus is easy to operate with one hand, for example, in the front upper side portion, and the speech speed changeover switch 113 is provided in the right plan view.

The pushbutton of the aforementioned slow switch 104 is formed so as to be larger than the other pushbuttons because the frequency of pushing of it is higher. Further, because the continuous slow pushing of the pushbutton is tiring, the pushbutton is provided so that it can be fixed. For example, there are used (1) a slide lock type in which the pushbutton is locked when it is pushed and slid laterally, (2) a double click type in which the pushbutton is locked when it is clicked twice, (3) a type in which the hold of the pushbutton is released when the reset pushbutton is pushed, and so on.

The aforementioned speech speed changeover switch (speech speed setting switch) 113 is disposed close to a range allowing the operation thereof with the same finger so that this switch and the slow switch 104 can be operated alternately.

Besides the position in the aforementioned embodiment, a ring switch, a slide switch, and so on, may be used to make the operation easier.

The aforementioned voice volume 108 is also disposed in a range allowing the operation with the same finger so as to be easy to adjust in order to always make hearing in appropriate voice volume possible.

Further, a switch which has a feeling of soft touch so that the microphone 321 does not pick up click noise of the switch is preferably used as the aforementioned switches high in the frequency of use, such as the slow switch 104, the repeat switch 105, the reset switch 106, the speech speed changeover switch 113, and so on. For example, a switch using electrically conductive rubber or the like is used.

Further, the external appearances of the aforementioned respective switches are preferably formed into surface states which are different in the tactile feeling in order to identify the switches in kind without seeing.

When the aforementioned finger stop hollow 103 is opened, a structure is made so that some switches such as a speech speed selection switch at repeat time, and so on, are seen.

The internal circuit structure of the speech speed conversion apparatus in this embodiment is formed so as to be identical to the aforementioned circuit structure shown in FIG. 1.

As the PTL switch 4 in the previous embodiment, there are used the slow switch 104, the repeat switch 105, the reset switch 106, and so on, as described above. Further, as the selector switch 3 in the previous embodiment, there is used the speech speed changeover switch (speech speed setting switch) 113. Further, the speech speed changeover switch (speech speed setting switch) 113 is connected to the external interruption flag terminal 13 contained in the DSP 1. The numeral value of the flag register 14 is changed by the changeover of the speech speed changeover switch 113, so that the software 11 changes the expansion rate of the speech speed conversion process in accordance with this numerical value.

Figure 11:
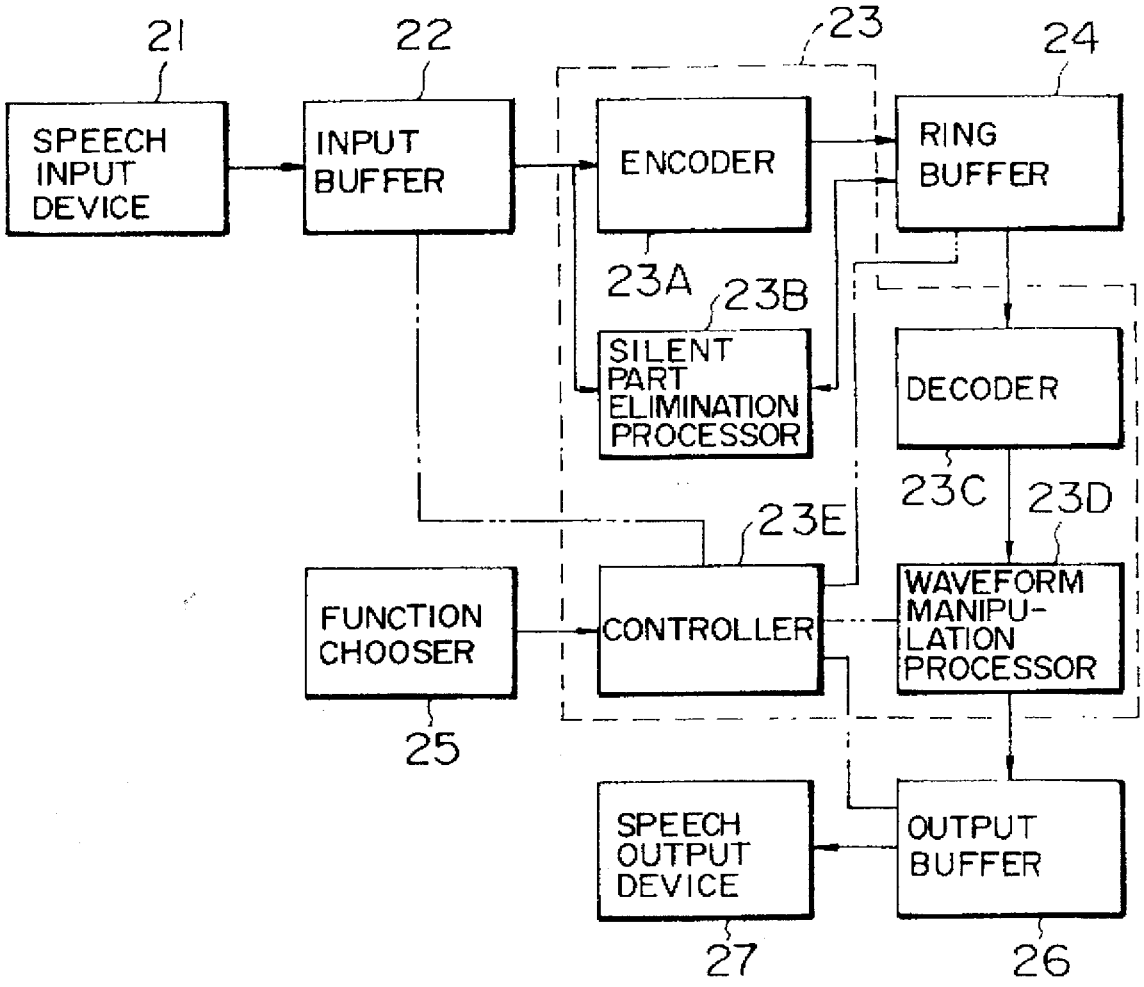
FIG. 11 is a block diagram showing the functional structure of the speech speed conversion apparatus according to present invention.

FIG. 11 is a block diagram showing the functional structure of the speech speed conversion apparatus in this embodiment, in which the reference numeral 21 designates speech input devices; 22, input buffers; 23, a central processing unit (CPU); 24, a ring buffer memory (which corresponds to the memory 2 in FIG. 1); 25, a function chooser; 26, output buffers; and 27, speech output devices.

Making the constituent parts of this embodiment correspond to those of the previous embodiment, the speech input devices 22 are constituted by the microphone 321, analog amplifier 10, low-pass filter 7 and A/D converter 5 of FIG. 1.

The aforementioned input buffers 22 serve to hold a speech converted into a digital signal by the aforementioned speech input devices 21 and have a size enough to hold data of the length of one frame which is a unit for signal processing after that. These input buffers 22 can be realized by the allocation of a part of addresses of the ring buffer memory 24 (which corresponds to the memory 2 in FIG. 1).

The aforementioned central processing unit (CPU) 23 which corresponds to the portion of software executed on the DSP 1 shown in FIG. 1, has an encoder 23A, a silent-part elimination process 23B, a decoder 23C, a wave-form manipulation process (speech speed conversion process) 23D, and a controller 23E.

The aforementioned function chooser 25 which corresponds to the portion constituted by the switches 3 and 4 and the external interruption flag terminal 13 shown in FIG. 1, is constituted by the slow switch 104, the repeat switch 105, the reset switch 106, the speech speed changeover switch 113, and so on, as described above.

The aforementioned output buffers 26 which serve to hold resulting data processed by the aforementioned wave-form manipulation process 23D are two in practice and each of them has a size enough to store data of the length of one frame expanded by wave-form manipulation. In the previous embodiment, two input buffers are provided so that a pipe-line process is realized by using them alternately, whereas in this embodiment a pipe-line process is realized by using two output buffers alternately in the same manner as in the previous embodiment.

That is, while the wave-form manipulation process of one frame is carried out so that a result of the process is held in one output buffer, a result of the wave-form manipulation process obtained in the previous cycle is outputted from the other output buffer via the speech output devices 27. These output buffers 26 can be realized by the allocation of a part of addresses of the ring buffer memory 24 (which corresponds to the memory 2 in FIG. 1).

The inputting of data to the input buffers 22 and the outputting of data from the output buffers 26 are carried out at intervals of the sampling rate of the A/D converter 5 and of the D/A converter 6 in the same manner as in the previous embodiment. The process executed by the DSP 1 is therefore constituted by a wave-form manipulation process for each frame and an interruption process executed at sampling intervals.

That is, the interruption process is executed any number of times while the wave-form manipulation process is applied to data of the length of one frame, so that the two processes are executed apparently and simultaneously.

As the aforementioned ring buffer memory 24, there is used a well-known type memory in which writing/reading is performed for each frame. The details thereof will be described below.

(Writing Operation)

In FIG. 11, speech data inputted through the speech input devices 21 are held in the input buffers 22. The input buffers 22 have a capacity enough to hold a number of data corresponding to one frame so that the code length of 16 bits per one data is allocated thereto, and the input buffers 22 are realized by the allocation of a part of addresses on the memory 2 shown in FIG. 1.

The controller 23E shown in FIG. 11 monitors the state of these input buffers 22 and transfers speech data of the length of one frame to the encoder 23A whenever the input buffers 22 are filled with the data of the length of one frame.

Figure 12A:
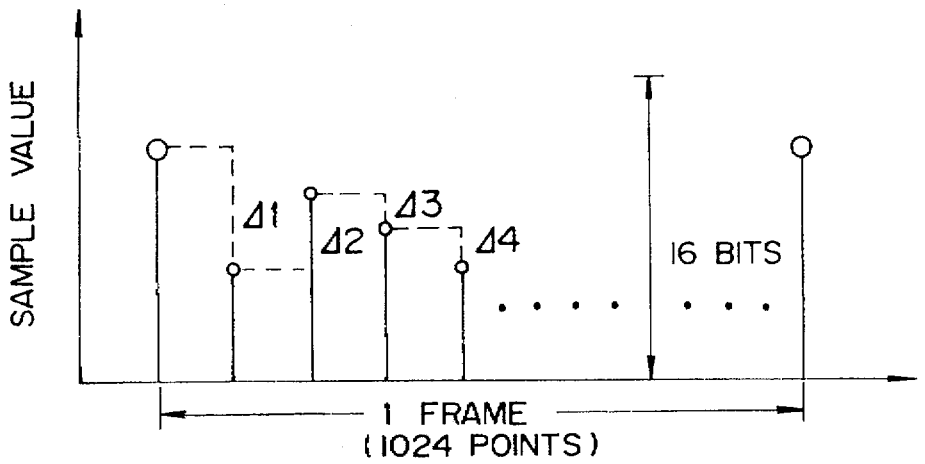
FIGS. 12A and 12B are typical graphs for explaining a compression process in a speech compression portion according to present invention.
Figure 12B:
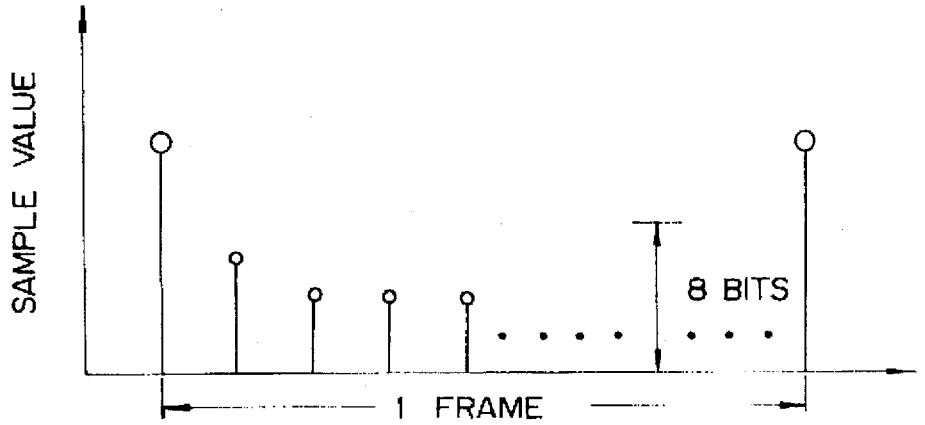

In the encoder 23A, the input speech data of the length of one frame is subjected to an information compression process, so that the data as a result of the compression is held in the ring buffer memory 24. Several methods are considered as this compression process. One example thereof is a difference data holding method shown in FIGS. 12A and 12B. FIGS. 12A and 12B are typical graphs for explaining the compression process in the encoder 23A in this embodiment.

In this compression process, "difference from the previous data" is calculated successively from the leading data of each frame. In FIG. 12A, these difference data are expressed as $\Delta 1, \Delta 2, \ldots$ The output data of the compression process are data obtained by arranging the aforementioned difference data $\Delta 1, \Delta 2, \ldots$ into the code length of 8 bits per one data after dividing the leading data of the frame into upper 8 bits and lower 8 bits. One data of the input data has a digital code length of 16 bits. In the case of an input signal such as a voice signal which changes sufficiently slowly compared with the sampling interval, the difference from the previous sampling value is however not so large that the difference can be expressed sufficiently in the code length of 8 bits which is a half as shown in FIG. 12B. The capacity of data after the compression process is therefore about a half the capacity of data before the compression process but there is no missing from the contents thereof as long as the difference in the middle of the process does not become too large to be expressed in the code length of 8 bits.

In the storage into the ring buffer memory 24, data thus compressed into a half capacity for each frame are arranged on the ring buffer memory 24 so that the time sequence thereof is maintained.

In addition to this, a frame header is added to the leading of the compressed data of each frame in order to indicate a break between frames. In the compression process portion, the calculation of the sum of the absolute values of all data in the frame as well as the aforementioned compression process in FIG. 12 is carried out and, at the same time, the work of recording a result thereof as the power value of this frame in the aforementioned frame header portion is carried out.

The determination of a frame to be subjected to the waveform expansion/reduction process is performed on the basis of comparison between the power of the frame and the threshold Th. Further, the silent-part elimination process is carried out on the basis of comparison between the power of the frame and the threshold To.

It is preferable that these thresholds are not used as fixed values but changed in accordance with the loudness of the input voice. For example, between the case of use in a quiet room and the case of use in a situation of large background noise, speech speed conversion, of course, cannot be performed well unless these thresholds are adjusted well.

In a specific realization method, the maximum/minimum values of frame power in the past period of several seconds are stored so that the aforementioned thresholds are determined on the basis of these values. For example, in the case where these thresholds are to be changed at intervals of five seconds in the condition in which the time length of one frame is 50 milliseconds (msec), the process of changing the threshold Th can be carried out once whenever 100 frames are processed.

As described above, the power of each frame is always calculated with respect to all inputs whenever information compression is performed for each frame by the encoder in FIG. 11, so that information thereof is recorded in the frame header and held in the ring buffer 24.

In this calculation of frame power, the maximum frame power Pmax and the minimum frame power Pmin are compared with each other so that they are updated if necessary. If the maximum frame power Pmax and the minimum frame power Pmin are provided so as to be reset at intervals of five seconds (100 frames), the maximum frame power and the minimum frame power in the past period of five seconds can always remain.

In the calculation of the thresholds, for example, Th and To are set to 10% and 5% the difference between the maximum frame power Pmax and the minimum frame power Pmin, respectively. These are given by the following expressions (1) and (2).

$$Th=|Pmax-Pmin|*0.10+Pmin \quad (1)$$

$$To=|Pmax-Pmin|*0.05+Pmin \quad (2)$$

Although the method of holding raw data in the ring buffer memory 24 in this embodiment has been described above, the details of silent-part elimination will be described below.

As explained in the previous embodiment with reference to FIG. 3, the function of silent-part elimination serves to eliminate a silent part (a duration in which power is lower than the voice-part/silent-part threshold To) continued for a time not smaller than one second.

Figure 14:
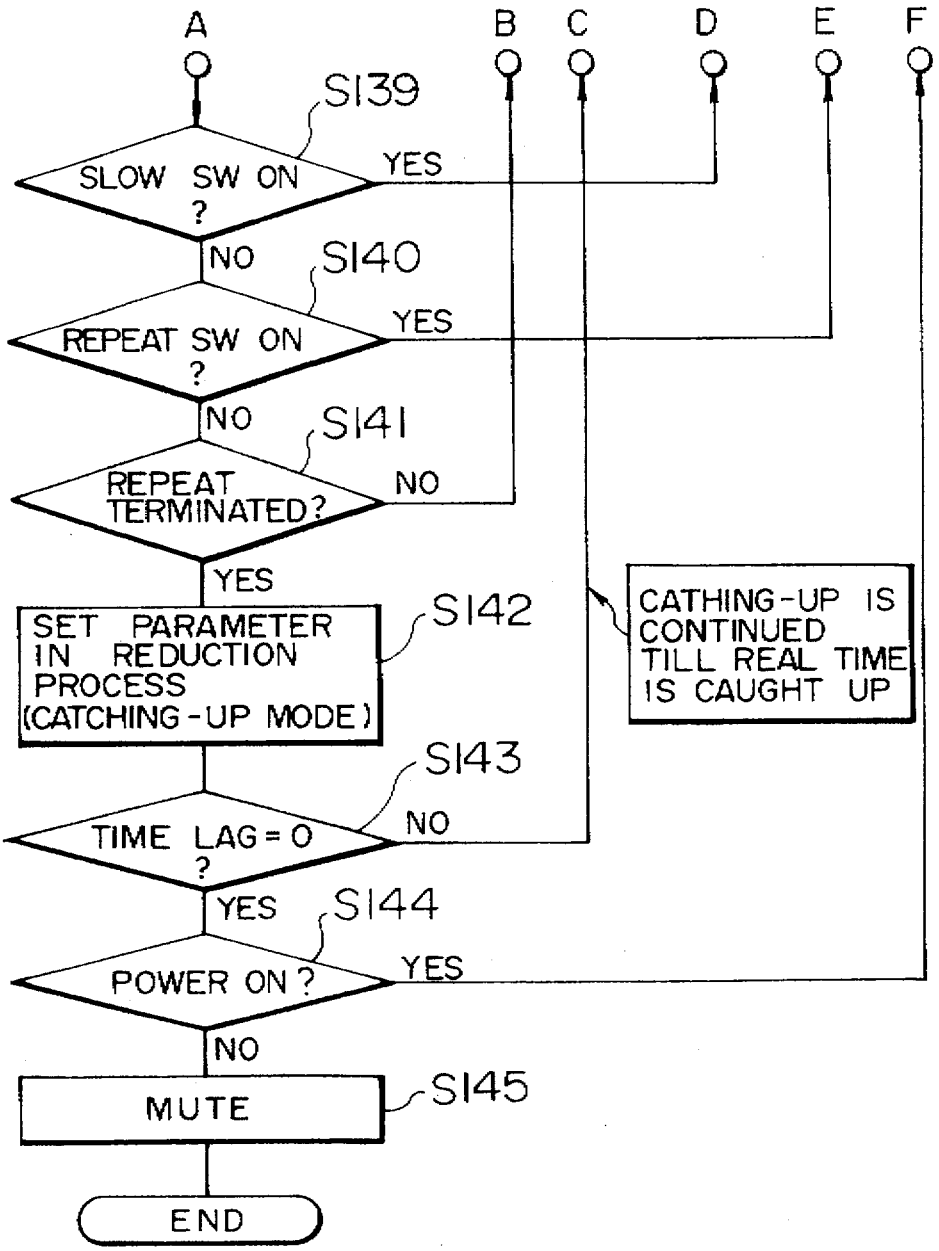
FIG. 14 is a flow chart to be continued from the flow chart of FIG. 13.

The silent-part elimination process is carried out by the silent-part elimination process 23B shown in FIG. 11. This silent-part elimination process is a process independent of a later-described process executed for each frame (hereinafter referred to as a main process) so that the process is carried out after the main process for one frame is terminated. In FIG. 14, the process is carried out between the judgment "delay=0?" (S143) and the judgment "Power ON?" (S144) (though not shown).

In the silent-part elimination process 23B, data accumulated in the input buffers 22 are added up at intervals of a predetermined unit (for example, ¼ frame) to calculate power, so that the silent-part elimination operation is started when the power "crosses the voice-part/silent-part threshold upwards". This is because the point of time of termination of the silent part is the point of time of the change of power from a small value to a large value and, at any point of time except this point of time, a judgment cannot be made as to whether the silent part continued up to that is longer than one second or not.

When the silent-part elimination process is started, first the frame header of the ring buffer memory 24 is retrieved retroactively to the past. Compressed data on the ring buffer memory 24 are compressed for each frame and, as described above, the power value of the frame is recorded in the frame header. If a frame having power lower than To is continued for a time not smaller than one second, silent-part elimination is enabled and the input pointer to the ring buffer memory 24 is returned to the point of time in which the silent part has been continued for one second. The input of the next compressed data is recorded so as to be overwritten from the returned point of time. Accordingly, the silent part continued for a time not smaller than one second just before the current point of time is always eliminated.

(Reading Operation)

The later-described main process in the apparatus of this embodiment is carried out for each frame. The wave-form manipulation process 23D shown in FIG. 11 therefore holds currently processed frame data, so that reading from the ring buffer memory 24 is performed collectively for each frame. That is, because addressing to the ring buffer memory 24 can be made easily by a process of increasing the address one by one simply in the case where data are collectively picked out, this case is better in efficiency than the case where data are one by one picked out.

Because the data stored in the ring buffer memory 24 are compressed data as described above, it is necessary that this compression is decoded into the original data before the wave-form manipulation process. The decoder 23C shown in FIG. 11 is provided for this purpose. First, leading two 8-bit data are arranged in the upper/lower of 16 bits with one-frame compressed data as an input to generate a leading data. Then, the value of the third data of the compressed data is added to the leading data to restore the second data. Then, the value of the next data of the compressed data is added to the second data to restore the third data. Thereafter, the work of adding the compressed data to the previously restored data successively is repeated thus to restore all data of the frame.

The basic operation of the speech speed conversion apparatus in this embodiment will be described below in brief.

As shown in FIG. 11, the speech converted into a digital signal by the speech input devices 21 is first inputted to the input buffers 22. The speech signal read from the input buffers 22 is fed to the encoder 23A contained in the CPU 23 of DSP1 (FIG. 1), subjected to the data compression process and stored in the ring buffer memory 24. The aforementioned speech signal is also fed to the silent-part elimination process 23B so that the silent-part elimination process is applied to the data stored in the ring buffer memory 24 if necessary.

The data of the speech signal stored in the ring buffer memory 24 are frame-by-frame fed to the decoder 23C, so that the compressed speech data are decoded by the decoder 23C and inputted to the wave-form manipulation process (speech speed conversion process) 23D. In the wave-form manipulation process (speech speed conversion process) 23D, there is carried out speech speed conversion or the like on the basis of the condition set by the function chooser 25. The digital speech data subjected to the speech speed conversion process or the like are held in the output buffers 26. The data of the output buffers 26 are read out so that the speech subjected to the speech speed conversion process or the like is outputted from the speech output devices 27.

That is, the data of the output buffers 26 are read out so that the data are converted from a digital value into an analog value at intervals of a set time by the D/A converter 6 as shown in FIG. 1. The analog signal thus obtained by this conversion is inputted to the analog amplifier 9 via the low-pass filter 8 and outputted as a voice from the binaural headphone 325 in listener's favorite amplitude of speech signal.

Figure 13:
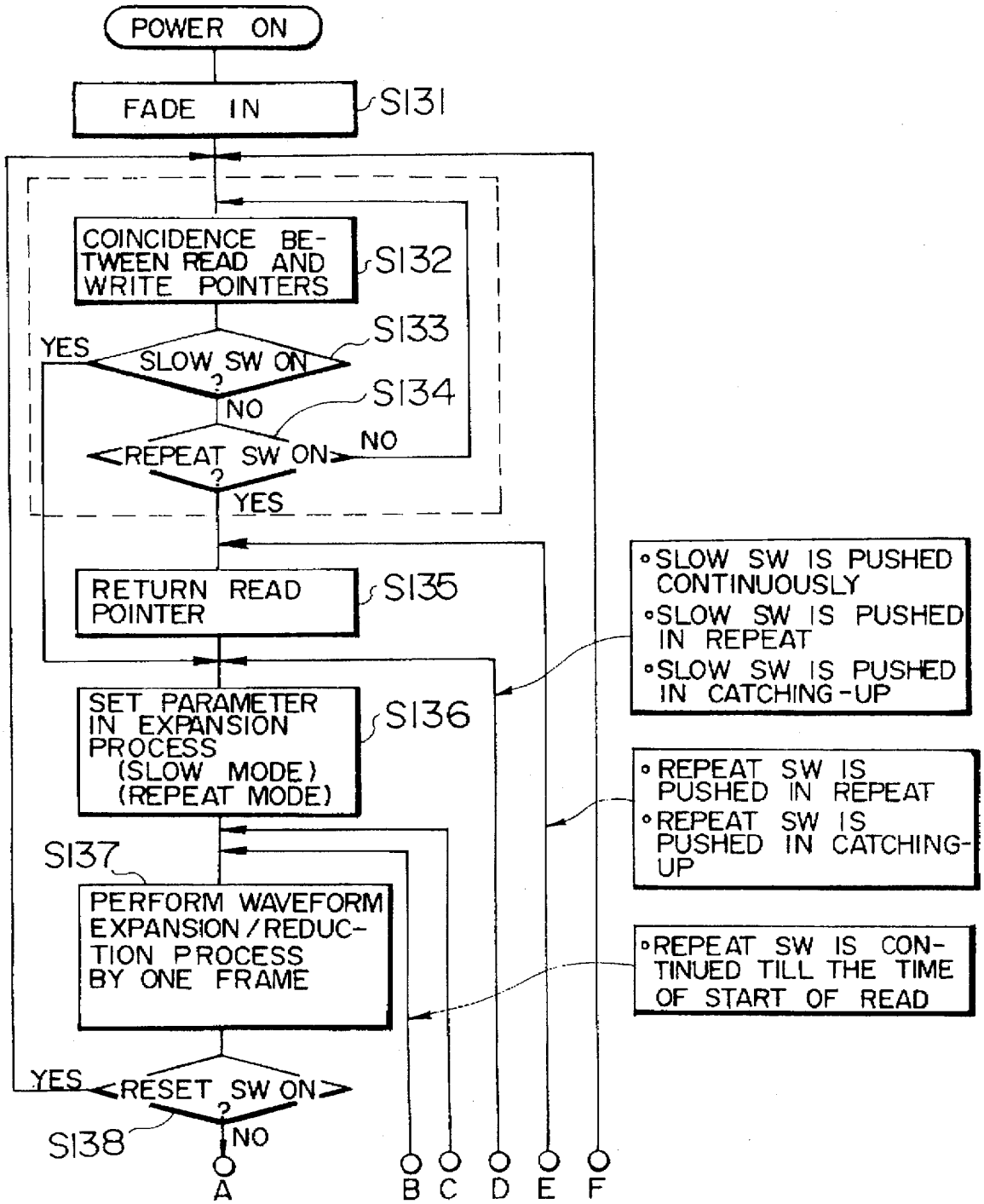
FIG. 13 is a flow chart showing the procedure of a main process according to present invention.

Referring to FIGS. 11, 13 and 14, the process executed for each frame (hereinafter referred to as a main process) in this embodiment will be described below.

FIGS. 13 and 14 are flow charts showing the procedure of the main process in this embodiment.

As shown in FIG. 13, in the main process in this embodiment, the "fade-in" step is carried out (S131) with Powering ON. That is, just after the powering-on of the electric source, data stored in the output buffers 26 are indefinite. Just after the powering-on of the electric source, data having no relation to the speech may be therefore outputted. In the case where the data are outputted intact from the speech output devices 27, the data may form noise of a very large level. To prevent this, in this embodiment, the values of data in the output buffers are adjusted by the execution of the fade-in step so that the output of the speech output devices is increased gradually for a predetermined time after the powering-on of the electric source irrespective of the data in the output buffers. Specifically, whenever one data is transferred from the output buffers to the D/A converter, the value of this data is multiplied by a coefficient, so that this function is realized by changing the value of the coefficient with the passage of time. This operation is executed by the controller 23E shown in FIG. 11.

Thereafter, the "through mode" process is started. In the through mode process, first, the "reading pointer coincidence" step is carried out (S132). This reading pointer coincidence process is a process in which when data from the speech input devices 21 is inputted, the same data is inputted to the output buffers 26 just after the inputting of the data to the input buffers 22. This operation is realized by making the value of the input pointer pointing an input address on memory coincident with the value of the output pointer pointing an output data address on memory just after the inputting of data to the input buffers 22. In FIG. 11, this operation is carried out by the controller 23E.

After the reading pointer coincidence, in the through mode, the pushed states (ON states) of the slow switch 104 and the repeat switch 105 are checked (S133 and S144). In the case where both switches are in non-pushed states (OFF states), the situation of the routine goes back to the previous reading pointer coincidence step (S132) so that the through mode is continued. Accordingly, in the interruption process which occurs while the through mode is continued, input data is always outputted intact, so that the same speech as the input speech is outputted from the speech output devices 27.

In FIG. 11, the aforementioned respective switches such as the slow switch 104, the repeat switch 105 and the reset switch 106 are contained in the function chooser 25 and the states thereof are checked by the controller 23E.

Figure 16:
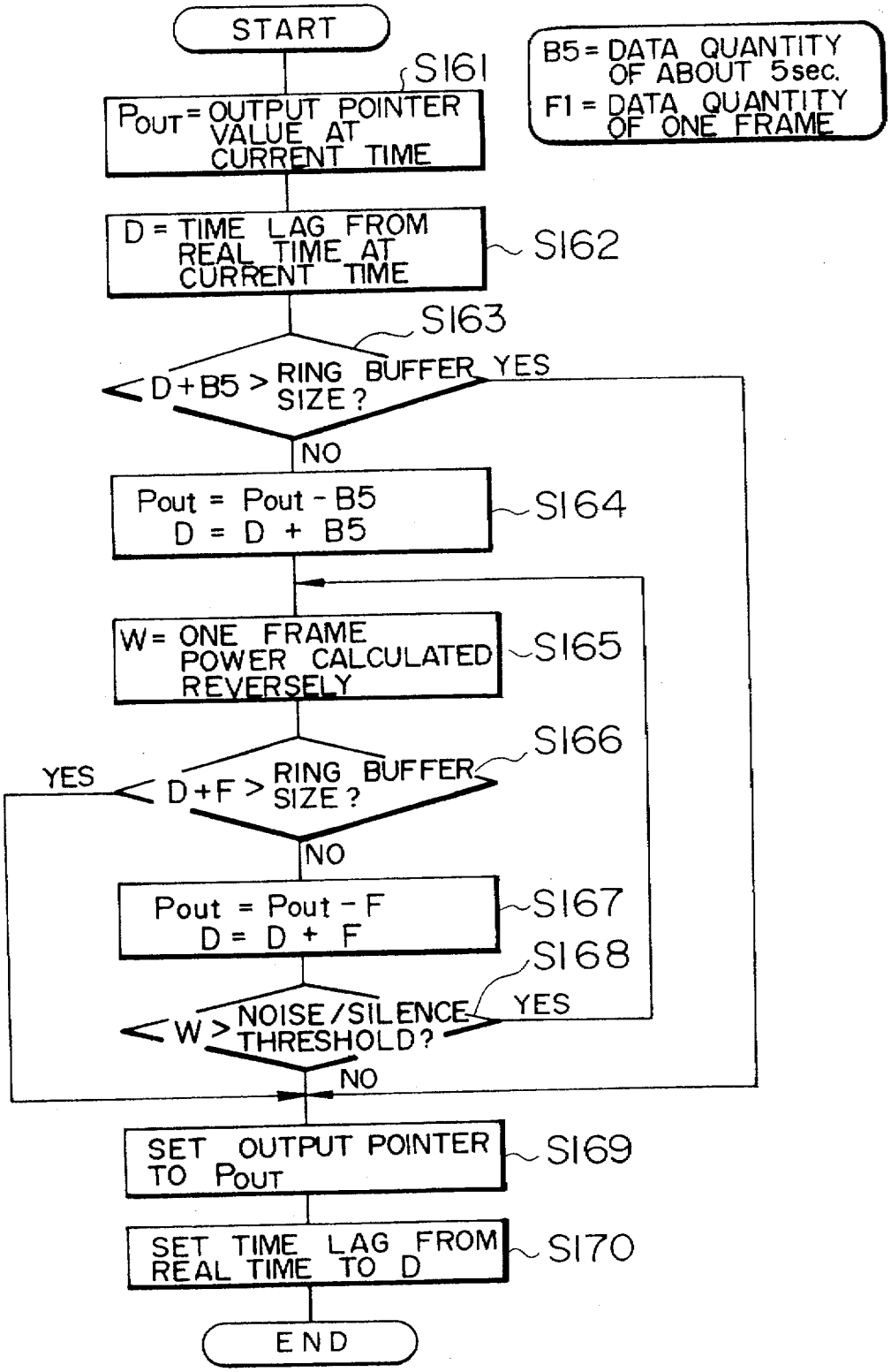
FIG. 16 is a flow chart showing the procedure of a reading pointer return routine according to present invention.

When the repeat switch 105 is pushed (turned ON) in the aforementioned through mode, a repeat flag (not shown) prepared separately is set from 0 to 1 and the "reading pointer return" routine is carried out (S135). FIG. 16 shows a flow chart of the internal procedure of this reading pointer return routine. The explanation of FIG. 16 will be described later.

Figure 17:
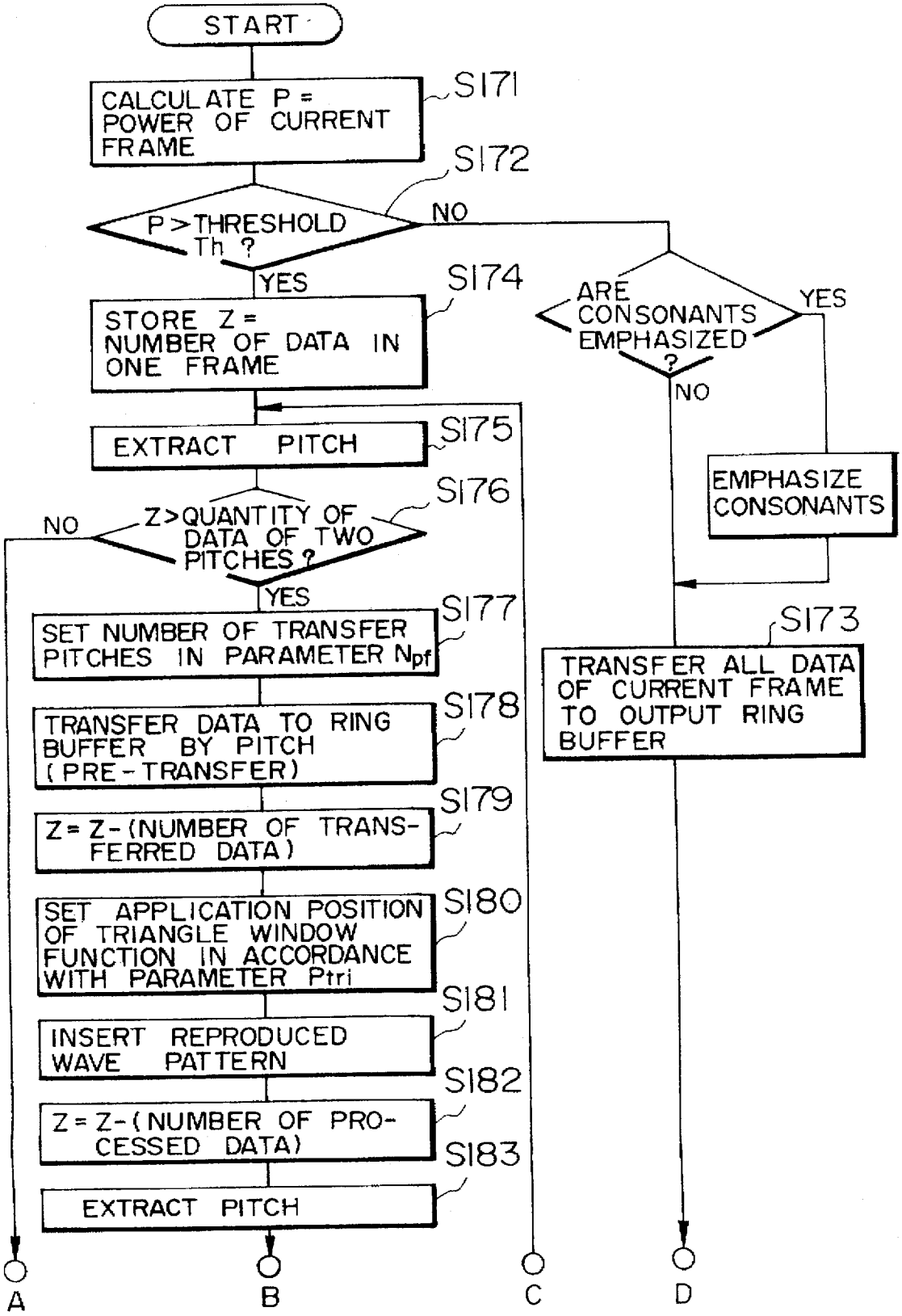
FIG. 17 is a flow chart showing the procedure of a one-frame waveform expansion/reduction process according to present invention.

When the slow switch 104 is pushed in the aforementioned through mode, the situation of the routine skips to the routine for "setting parameter in expansion process" (S136) as shown in FIG. 13. FIG. 17 shows a flow chart of the internal procedure of this routine. The explanation of FIG. 17 will be described later.

Figure 18:
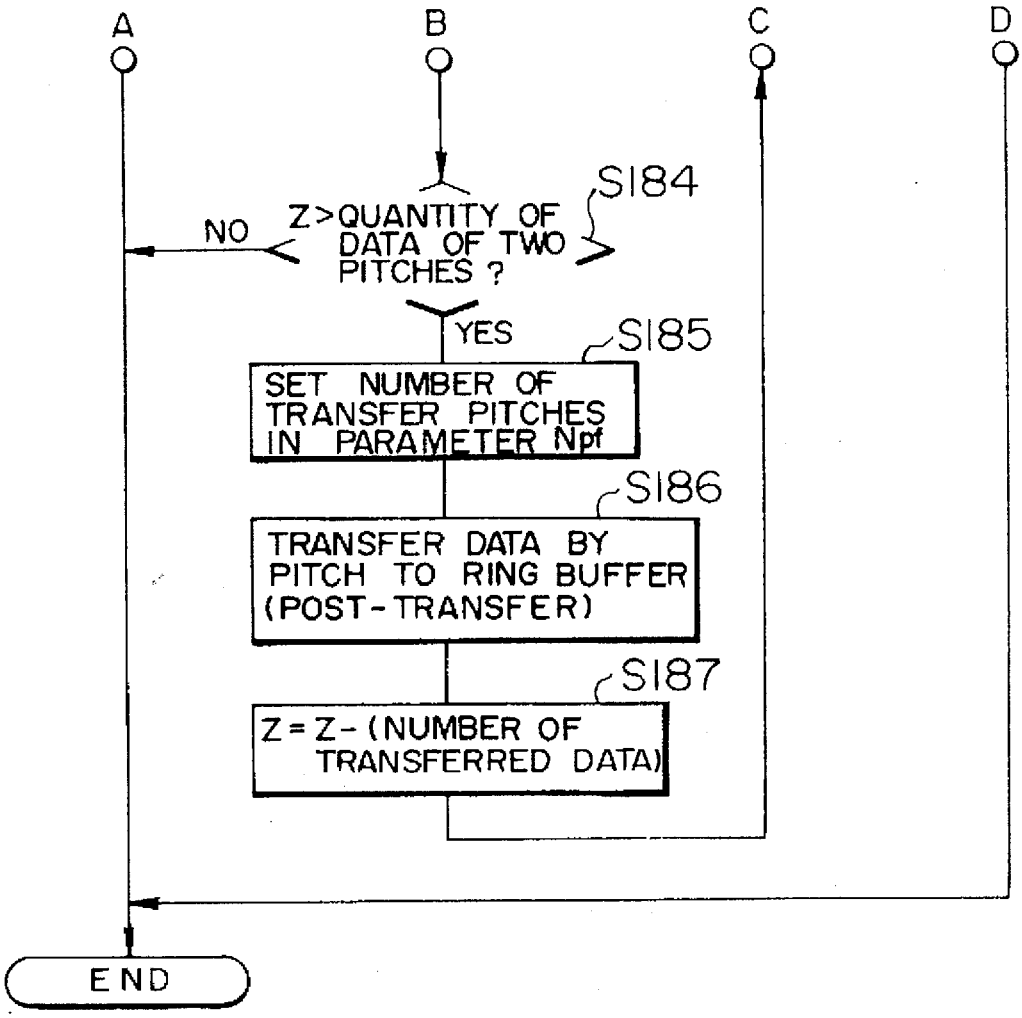
FIG. 18 is a flow chart to be continued from the flow chart of FIG. 17.
Figure 19:
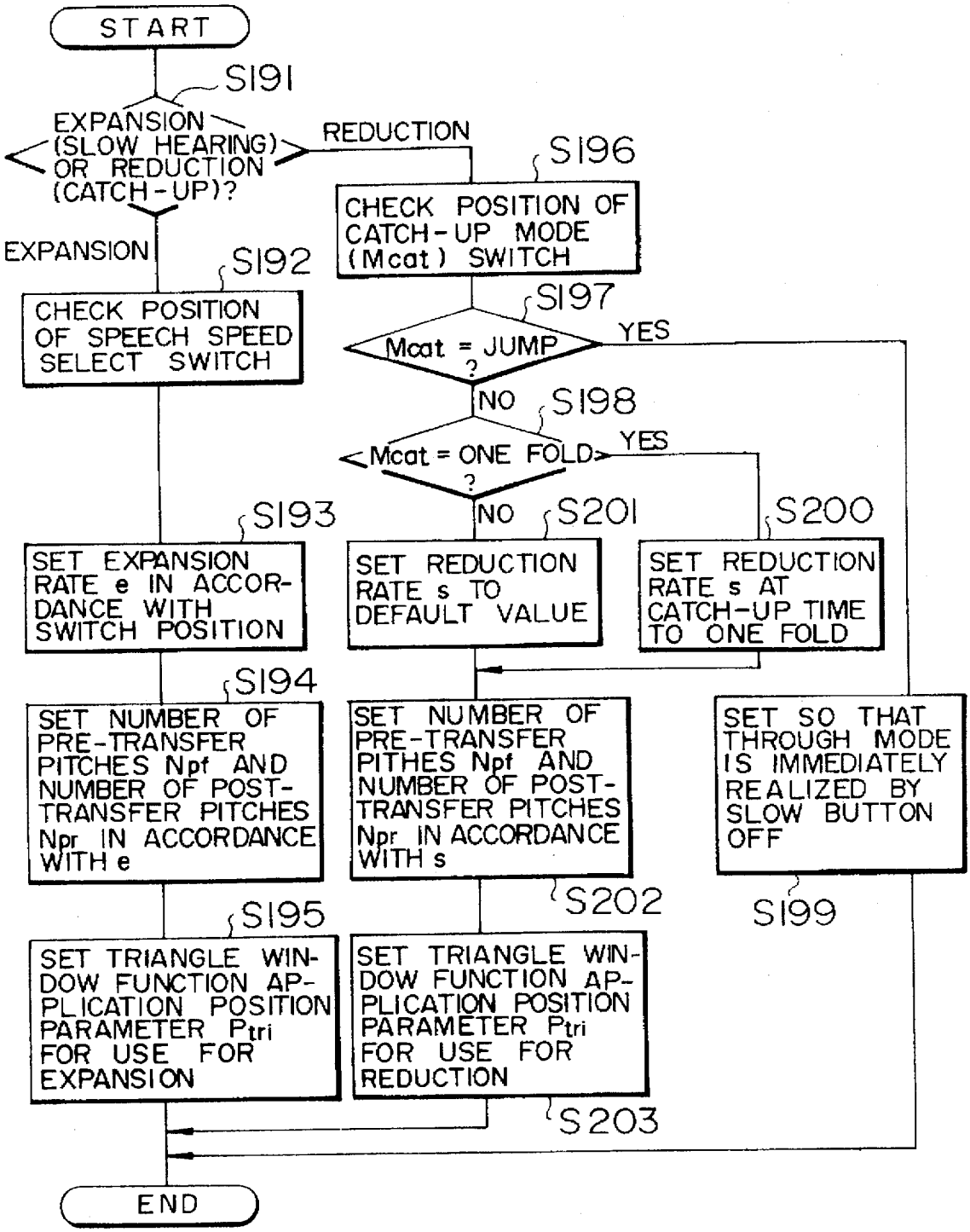
FIG. 19 is a flow chart showing the procedure of a parameter setting process according to present invention.

After the setting of parameter in the expansion process is performed, the one-frame waveform expansion/reduction process is carried out (S137). FIGS. 18 and 19 show flow charts of the internal procedure of this one-frame waveform expansion process. The explanation of FIGS. 18 and 19 will be described later.

After the aforementioned one-frame process is completed, the situation of the routine goes to the step for checking the states of the respective switches as to whether each switch is pushed or not. Hereupon, because the one-frame process is terminated within the time length of one frame, the process is completed in the order of tens of milliseconds (msec). On the other hand, switching devices which are such that the pushed states are maintained for a time not shorter than the duration of pushing, no matter how short, in the case where the respective switches (pushbuttons) are pushed by a user, are used in this apparatus. Accordingly, the situation of the routine can be shifted to a desired operation with such a time lag that a feeling of slow response is not given to the user, as long as the pushed states of the switches are checked whenever the one-frame process is carried out.

First, whether the reset switch 106 is pushed down or not is checked (S138). If the reset switch 106 is pushed down (in the case of Yes in S138), the current mode forcedly goes to the through mode at this point of time.

If the reset switch 106 is not pushed down (in the case of No in S138), whether the slow switch 104 is pushed down or not is checked (S139) as shown in FIG. 14. If the slow switch 104 is pushed down (in the case of ON: in the case of Yes in S139), the situation of the routine goes back to the routine in which parameter is set in the expansion process so that the wave-form expansion process is applied to the next frame continuously. In the case where the slow switch 104 is pushed down continuously, the situation of the routine circulates in this loop continuously. Further, even in the case where the slow switch 104 is pushed down continuously during the repeat reproduction and catching-up reproduction, the situation of the routine circulates in this loop continuously.

In the case where the slow switch 104 is opened (in the case of OFF: in the case of No in S139), the situation of the routine goes to the next judgment as to the repeat pushed-down state (S140). The case where the pushing-down of the repeat switch 105 is detected at this point of time is either the case where "the repeat switch is pushed at the time of repeat reproduction" or the case where "the repeat switch is pushed at the time of catching-up reproduction". In either case, the situation of the routine branches into the reading pointer return routine so that the repeat reproduction is started from the silent part near a position returned back to the past by about five seconds from the current position of the output pointer of the ring buffer memory 24.

In the case where the slow switch 104 is opened and the repeat switch 105 is not pushed down, the situation of the routine goes to the following repeat end judgment (S141). The repeat operation is continued until the output pointer goes back to the output pointer position where the through mode was changed to the repeat operation by the pushing-down of the repeat switch 105. That is, in the case where this judgment shows that the repeat mode is used currently and that the position of the output pointer does not yet go back to the output pointer position where the repeat was started, a processing loop is formed so that the situation of the routine goes back to the aforementioned one-frame waveform expansion/reduction process. The subsequent process is a process for catching-up reproduction.

After the repeat reproduction is terminated or after the slow reproduction is terminated, the situation of the routine goes to the catching-up reproduction. The catching-up reproduction means an operation in which a time lag from the real time as caused by the repeat or slow reproduction is made up for by fast reproduction realized by the repetition of the one-frame waveform reduction process. In the process in this portion, the setting of parameter is performed for the waveform reduction process for the catching-up reproduction (S142).

The quantity of the lag from the real time increases when the repeat button is pushed down or when the waveform expansion process is carried out. On the contrary, it decreases when the waveform reduction process is carried out.

The process for increasing/decreasing this quantity of the lag is however not shown in FIGS. 18 and 19 which show the procedure (flow chart) of the one-frame waveform expansion/reduction process which will be described later.

A judgment is made as to whether the quantity of the lag from the real time is present or absent (S143). In the case where the quantity of the time lag is present yet, a processing loop is formed so that the catching-up reproduction is continued. That is, the operation in which the catching-up reproduction is continued until the quantity of the time lag becomes zero, is realized by this judgment.

On the other hand, in the main process described above, the time lag from the real time as caused by the speech speed conversion or repeat operation is managed as "lag quantity" by using a counter.

Although the time lag from the real time can be managed also as difference between the position on the ring buffer 24 where the current sampled data is inputted and the position on the ring buffer 24 where the position of data outputted is inputted, that is, as difference between addresses pointed by two pointers, the management method using the lag quantity counter as described above is employed in the present invention. This is because the quantity of the lag may be unable to be expressed correctly in the address difference between the input and output pointers on the ring buffer 24.

For example, assuming that the memory address space allocated to the ring buffer 24 is from address 0 to address 1000, then the ring buffer 24 is realized by the handling of the memory address space in a manner of "next to address 1000, jump to address 0" in the program. Therefore, in the case where the input and output pointers lie across this break between addresses, the quantity of data therebetween cannot be expressed easily by taking the difference between address values simply. In order to known the quantity of data between these pointers by address calculation, address value calculation including complex classification that takes into account the histories of the two pointers up to their current positions is required.

In the speech speed conversion apparatus according to the present invention, whenever reading/writing of data is performed with respect to the ring buffer 24, the value of the lag quantity counter is changed to thereby manage the quantity of the time lag to prevent the increase of the quantity of processing based on the complex address calculation.

The aforementioned main process is provided in the form of an infinite loop in which the aforementioned process is repeated until the electric source switch is turned off (S144).

In the case where the electric source switch is turned off, the process is not suddenly stopped but continued for a predetermined time before it is stopped (mute) (S145). During this time, here is carried out such a process that the loudness of the output voice is reduced gradually.

Specifically, in an interruption process in the same manner as in the fade-in operation which is the first step, whenever one data from the output buffers 26 is transferred to the D/A converter 6 shown in FIG. 1, the value of this data is multiplied by a coefficient so that this function is realized by changing the value of this coefficient with the passage of time. This operation is carried out by the controller 23E shown in FIG. 11.

Figure 15:
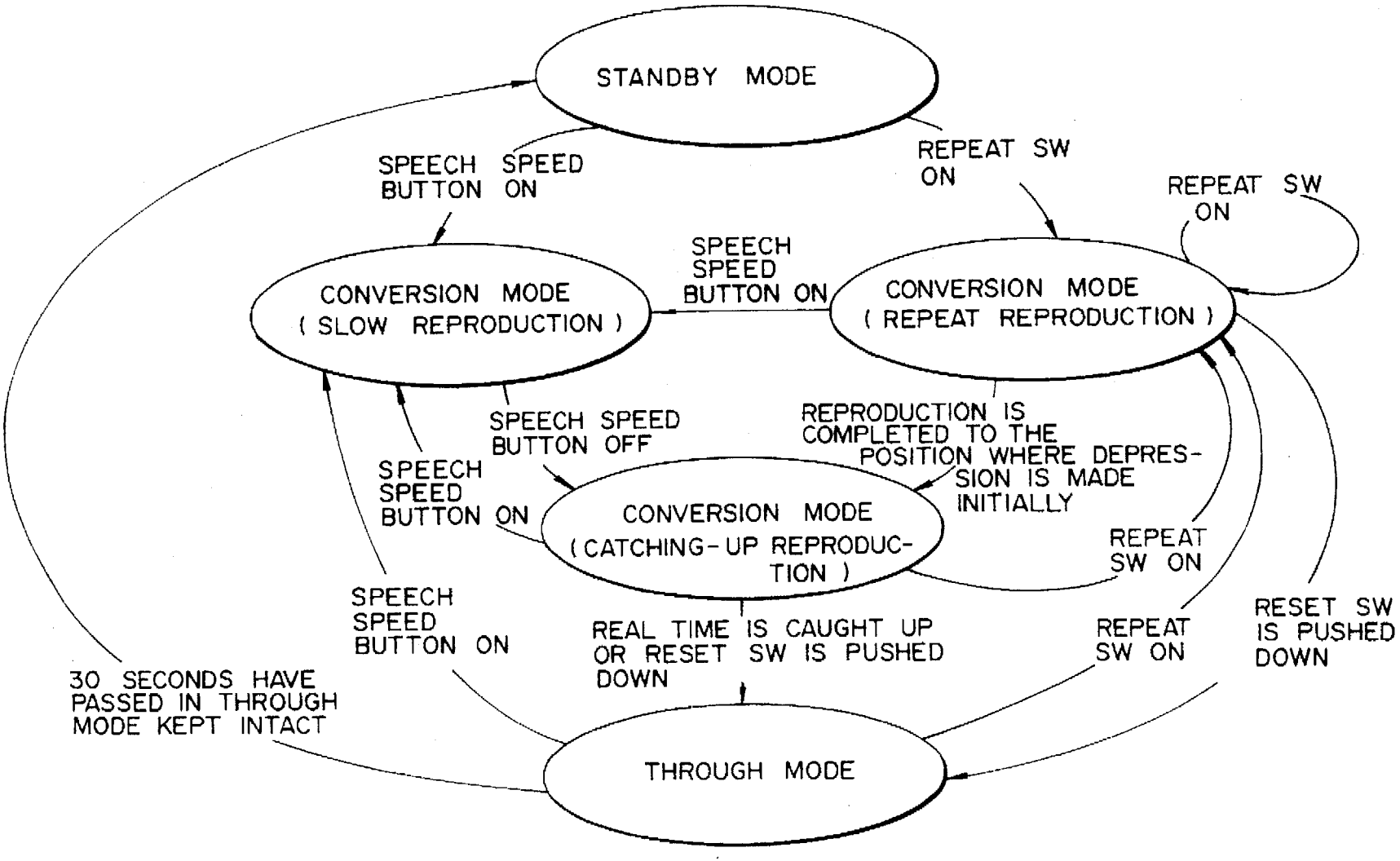
FIG. 15 is a state transition view typically showing transition between respective modes according to present invention.

FIG. 15 is a state transition view typically showing transition between respective modes in this embodiment as described above. The way of mode switching on the basis of the switching operation will be understood well from FIG. 15. Further, the standby mode in FIG. 15 will be described later in detail.

The details of processing operations in the respective routines in this embodiment described above will be described below in detail.

FIG. 16 is a flow chart showing the procedure of the reading pointer return routine.

The reading pointer return routine in this embodiment is a specific method for changing the value of the output pointer pointing the position of data to be read from the ring buffer 24, which method is necessary for realizing a repeat function.

As shown in FIG. 16, first, the position of the output pointer at the current point of time is set to Pout (S161). Then, the quantity of the lag from the real time at the current point of time is set to D (S162).

A judgment is made as to whether the quantity of the lag is already large at the current point of time so that the quantity of the lag will exceed the size of the ring buffer memory 24 if the quantity of the lag is further increased by 5 seconds (B5) (S163). In the case where a decision is made as a result of the judgment so that the quantity of the lag exceeds the size of the ring buffer memory 24 (the case of Yes in S163), this routine is terminated without any change of Pout and D (S169 and S170).

In the case where the quantity of the lag can be increased by five seconds (B5) (the case of No in S163), the pointer is returned back by five seconds (–B5) and the quantity of the lag is increased by five seconds (+B5) (S164).

Then, a process of searching back for the silent part is started so that the start of the repeat is made a pause of the speech. First, data is accessed backward from the position pointed by Pout on the ring buffer memory 24 to thereby calculate one-frame power (S165).

At this time, if the output pointer is returned back (–F) by one frame (F), the quantity of the lag is also further increased by one frame (+F). Here, a judgment is made as to whether or not the total quantity of the lag exceeds the size of the ring buffer memory if the quantity of the lag is further increased by one frame (S166), and in the case where a decision is made as a result of the judgment so that the total quantity of the lag exceeds the size of the ring buffer memory (the case of Yes in S166), this search for the silent part is stopped and Pout and D at this time are set as the output pointer vale and the lag quantity respectively (S169 and S170) whereafter this routine is terminated.

In the case where the total quantity of the lag does not exceed the size of the ring buffer memory (the case of No in S166) though the output pointer is returned back by one frame, Pout is returned back by the length of one frame and the quantity D of the lag is increased by one frame (S167) whereafter the calculated one-frame power W and the voice-part/silent-part threshold are compared with each other (S168). In the case where the one-frame power W is smaller than this threshold, a decision is made that a pause of the speech is present near this frame (the case of No in S168) and Pout and D at this time are set as the output pointer value and the lag quantity respectively (S169 and S170) whereafter this routine is terminated.

In the case where the one-frame power W is larger than this threshold (the case of Yes in S168), the pointer is further returned back by one frame and the search for the silent part is continued to detect the silent part in the same manner as described above but the search is continued until the quantity of the lag exceeds the size of the ring buffer memory. Thus, the output pointer return process at the time of the pushing of the repeat switch 105 is completed.

FIGS. 17 and 18 are flow charts showing the procedure of the one-frame waveform expansion/reduction process in this embodiment.

In the one-frame waveform expansion/reduction process in this embodiment, as shown in FIGS. 17 and 18, first of all, power of current one-frame data is calculated (S171). Then, this power value P is compared with the threshold Th (S172). A frame having higher power than the threshold Th is subjected to the following process. Data in a frame having lower power than the threshold Th may be outputted intact to be transferred to the ring buffer 24 (S173) or may be subjected to a consonant emphasis process and then transferred to the output buffers 26. Whether consonant emphasis is to be performed or not to be performed is determined by the state of the mode switch which is one of hidden switches.

As a specific method for realizing the consonant emphasis process, there is, for example, considered a method in which a frame having lower power than the threshold Th just prior to a frame having higher power than the threshold Th is regarded as a consonant and the values of data in the frame are increased.

In the case of a frame having higher power than the threshold Th in the aforementioned power judgment (the case of Yes in S172), first the number of data in one frame is stored in a variable Z indicating the quantity of not-yet-processed data (S174) and then the pitch extraction process is carried out from the leading of the frame (S175). Several methods are considered as the pitch extraction process. For example, the pitch length at the leading of the frame is extracted on the basis of a well-known algorithm using autocorrelation.

Then, the quantity of data corresponding to twice the thus extracted pitch length is compared with the quantity of not-yet-processed data (S176), and in the case where the quantity Z of not-yet-processed data is smaller the quantity of data twice as much as the extracted pitch, this process is stopped.

In the case where the quantity Z of not-yet-processed data is equal to or more than the quantity of data twice as much as the extracted pitch (the case of Yes in S176), a pre-transfer process is carried out (S178). The pre-transfer process means a process in which a part of input data is transferred intact to the output buffer 26 before a reproduced wave pattern insertion process which will be described later. The pre-transfer process corresponds to the portion of (b) in FIG. 2. The number of data to be transferred by the pre-transfer process is set with the pitch as a unit but the number thereof varies in accordance with the wave-form expansion/reduction rate. The number Npf is set (S177) by a parameter setting routine which will be described later with reference to FIG. 19. After the pre-transfer process is carried out (S178), the quantity Z of not-yet-processed data is reduced by the number of transferred data (S179).

Then, the position of application of a Δ window function for generating a reproduced wave pattern is determined (S180) in accordance with another parameter Ptri set in the parameter setting routine shown in FIG. 19. What differs between expansion and reduction is only the position on current wave to which the window function is applied in the case where a reproduced wave pattern is generated by using the Δ window function.

Figure 20:
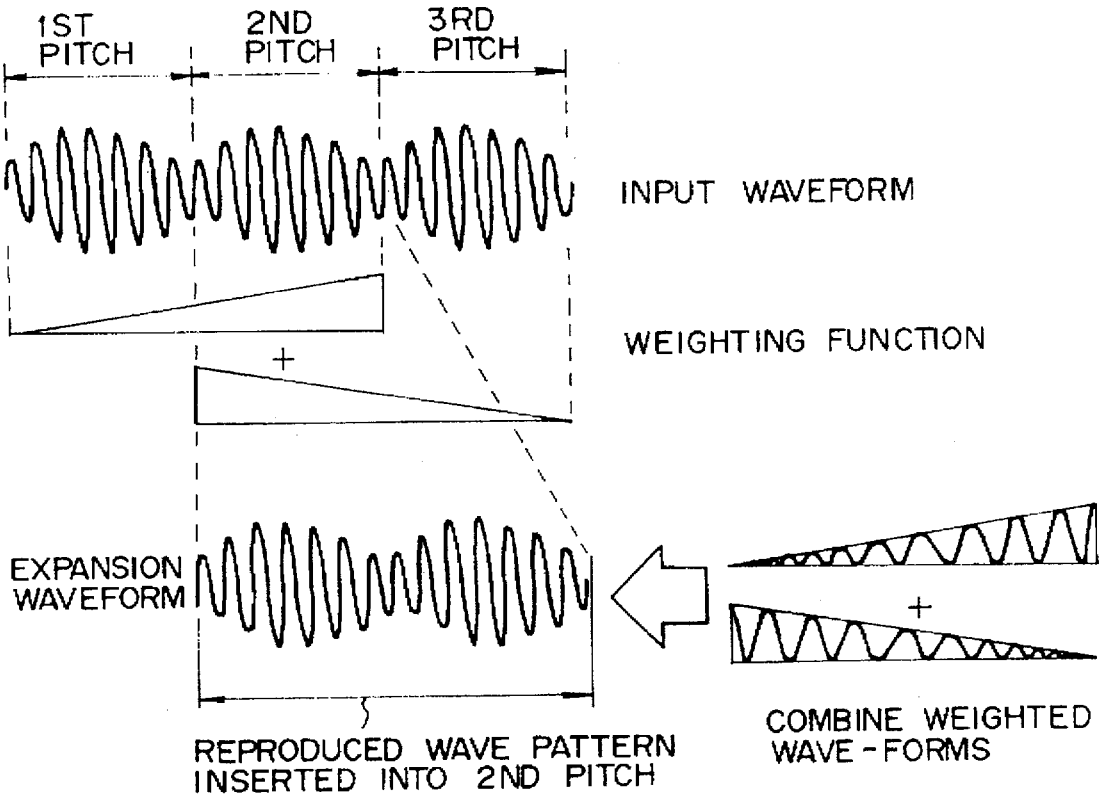
FIG. 20 is a view for explaining the data compression process according to present invention.
Figure 21:
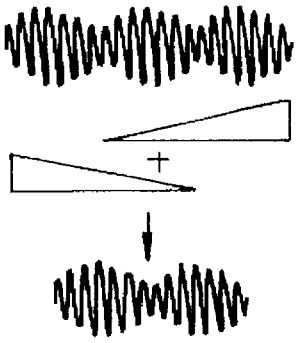
FIG. 21 is a view for explaining the data compression process according to present invention.
Figure 22:
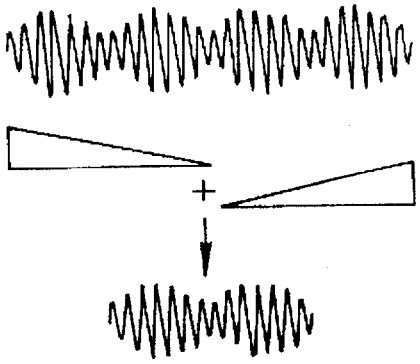
FIG. 22 is a view for explaining the data compression process according to present invention.

That is, in the case of waveform expansion, as shown in FIG. 2, the Δ window function is applied so that waveform of the length of two pitches is generated from waveform of the length of one pitch (S181). Contrariwise in the case of waveform reduction, as shown in FIGS. 20 to 22, the Δ window function is applied so that waveform of the length of two pitches is generated from waveform of the length of three or four pitches. The quantity of the lag from the real time is changed by the insertion of the reproduced wave pattern (though not shown).

After the reproduced wave pattern insertion process, the quantity Z of not-yet-processed data is reduced by the number of the thus processed data (S182).

Then, the pitch extraction process is carried out again (S183). This is a process which is adapted to the fact that the human voice pitch always varies and in which the error between the actual pitch length and the pitch length for processing is reduced by extracting the pitch again to thereby consequently prevent the increase of distortion in waveform after expansion/reduction.

Then, as shown in FIG. 18, the quantity of data twice as much as the newly extracted pitch is compared with the number of not-yet-processed data (S184). If the quantity of data of the length of two pitches does not remain (the case of No in S184), this process is stopped immediately.

If the quantity of data larger than the length of two pitches remains (the case of Yes in S184), a post-transfer process is carried out. The post-transfer process means a process similar to the pre-transfer process and corresponds to the portion of (e) in FIG. 2 in the previous embodiment. The number of data to be transferred by the post-transfer process is set with the pitch as a unit but the number thereof varies in accordance with the waveform expansion/reduction rate. The number Npf is set (S185) by the parameter setting routine which will be described later with reference to FIG. 19. After the pre-transfer process (S186), the quantity Z of not-yet-processed data is reduced by the number of transferred data (S187).

The aforementioned procedure is continuously repeated until this procedure is stopped on the basis of comparison between the quantity of data of the length of two pitches and the quantity of not-yet-processed data which comparison is performed twice in the middle of this procedure.

FIG. 19 is a flow chart showing the procedure of the parameter setting routine for setting parameter for the expansion process in this embodiment.

In practice, the parameter setting routine shown in FIG. 19 is used twice in the main process shown in FIGS. 13 and 14. Once thereof is used just before the aforementioned one-frame waveform expansion/reduction routine and the other once is used in a "process for setting parameter for the reduction process" after the repeat end judgment.

Hereupon, the waveform reduction process is a process for realizing the "catching-up process (fast hearing process)" which is continued after slow hearing or after repeating. When the generation of a reproduced wave pattern with use of the Δ window function as carried out in the waveform expansion process is carried out while the position subjected to the window function is shifted in a direction reverse to the case of expansion, waveform reduction is obtained.

In FIG. 19, first a discrimination is made between expansion and reduction (S191). This discriminates one of the aforementioned twice from the other.

In the case of parameter setting for the expansion process, after this discrimination, the position of the speech speed selection switch is checked (S192), the expansion rate e is set in accordance with the position of the switch (S193), the positions of parameters Npf and Npr used in the waveform expansion process are set in accordance with the expansion rate e, and parameter Ptri indicating the position of the start of weighted summation with respect to the Δ window as carried out in the waveform expansion process is set, whereafter this routine is terminated.

On the other hand, in the case of parameter setting for the reduction process, the right flow in FIG. 19 is carried out. First, the position of the catching-up mode switch (which is one of hidden switches) is checked (S196) and which of "jump", "fast hearing" and "one-fold" the catching mode (Mcat) is set to is checked (S197 and S198).

When set to "jump", the catching mode (Mcat) practically serves not to "catch up" but to jump actually just at the the basis of comparison between the one-frame power and the threshold Th. Escape out of the continuous speech speed conversion mode is achieved by the pushing-down of the reset switch 106.

In this embodiment, the speech is made slow or fast in accordance with the power thereof.

In ordinary conversation, there is generally a tendency that an important portion which must be told to a listener is louder-voiced but a portion not so important is smaller-voiced. Accordingly, the speech speed control in this embodiment is characterized in that an output voice nearer to the natural voice is obtained.

Figure 23:
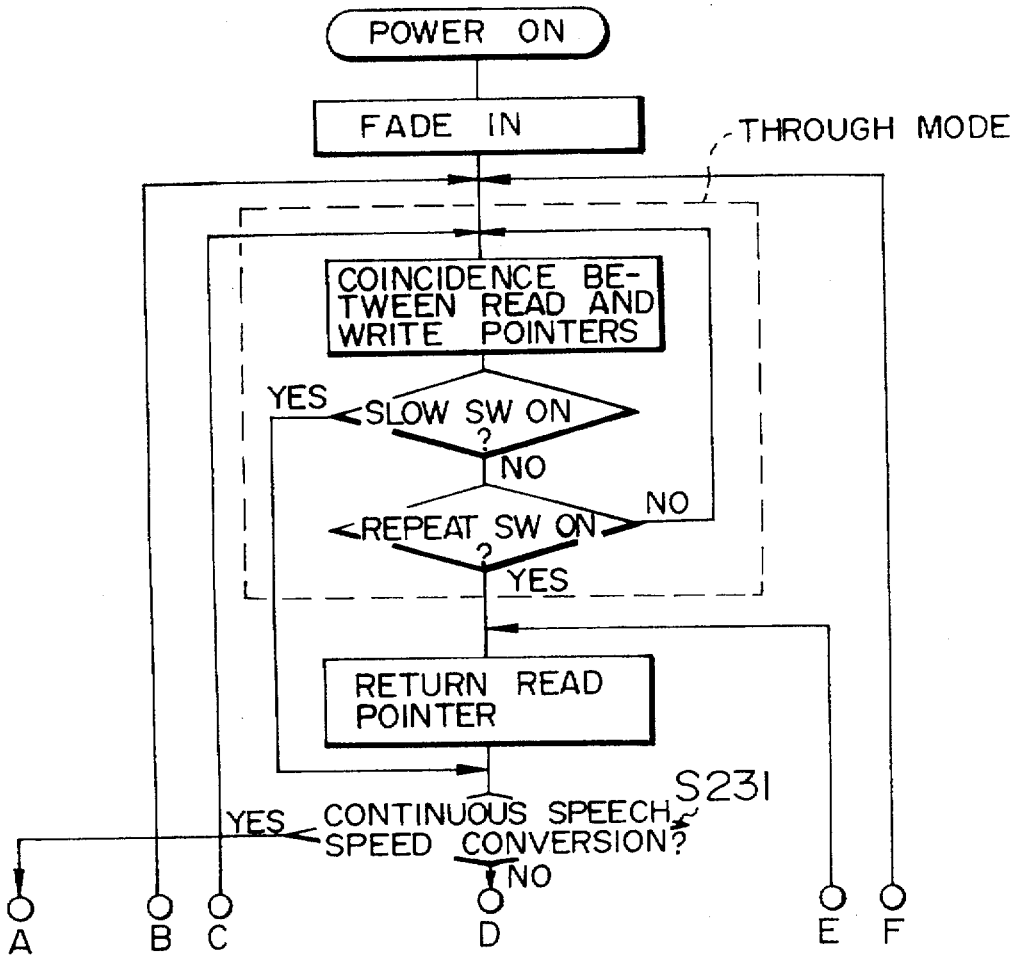
FIG. 23 is a flow chart showing the procedure of the total operation of the speech speed conversion apparatus provided with a continuous speech speed conversion means according to present invention.
Figure 24:
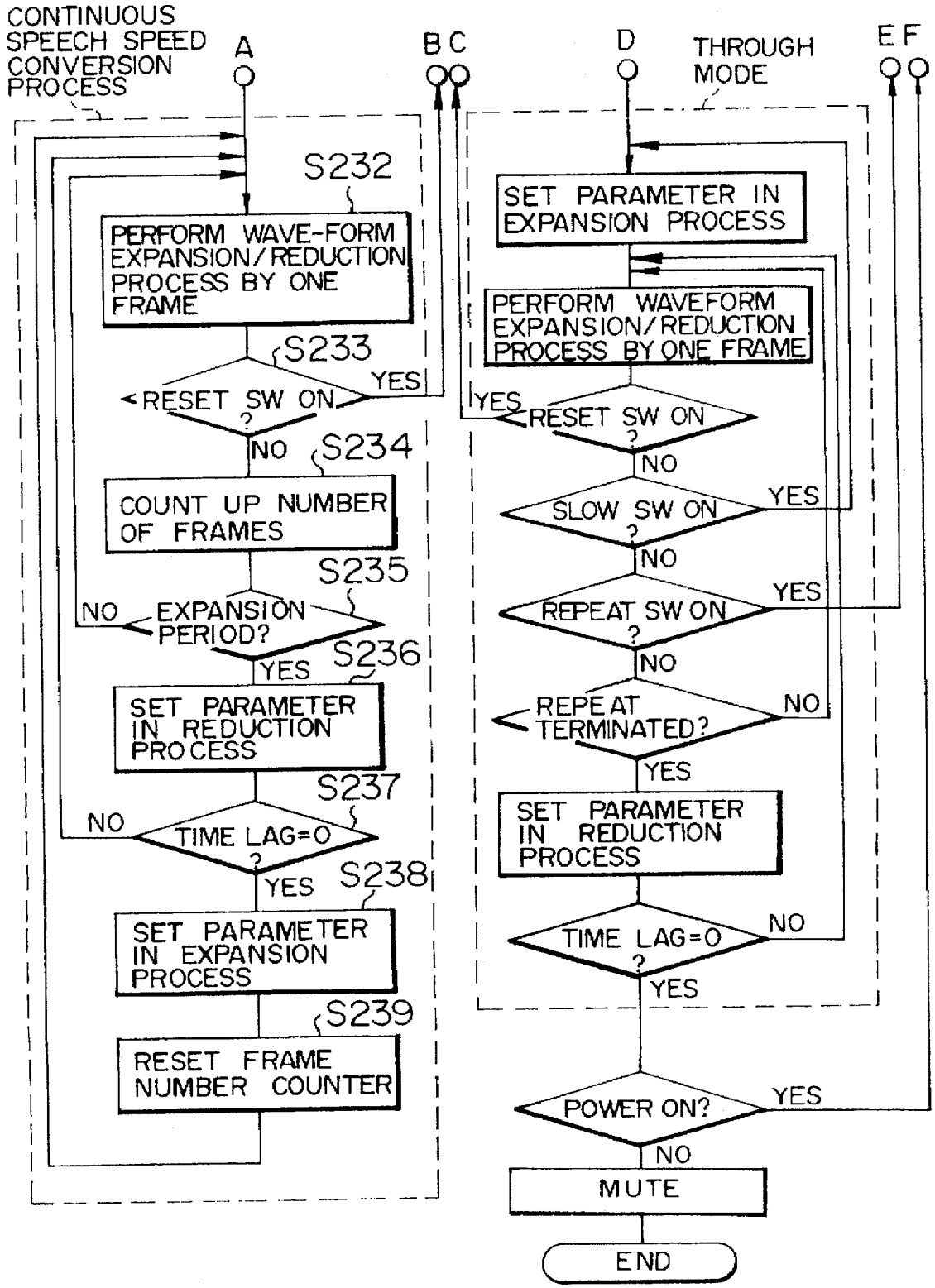
FIG. 24 is a flow chart to be continued from the flow chart of FIG. 23.

The probability of appearance of the high-power portion and the probability of appearance of the low-power portion are however not always equal to each other, so that catching up to the real time at intervals of a predetermined time as in the case of the previous embodiment of FIGS. 23 and 24 is not always ensured.

Further, as a method of instruction from the user to attain entry into the continuous speech speed conversion mode, there are considered a method in which the slow switch (slow pushbutton) 104 is pushed and then slid laterally to thereby be locked, a method in which the slow switch (slow pushbutton) 104 is double-clicked (pushed down twice in succession at a short time interval), and so on. If these methods are used, the respective intentions of "executing slow reproduction" and of "continuing" the operation by the pushing of the slow switch (slow pushbutton) 104 can be expressed in difference in the way of pushing of the same pushbutton so that there can be provided an operating system which is more intuitive and easier to understand compared with the case where a continuous speech speed conversion pushbutton is provided separately.

The embodiments up to now have been described above upon the assumption that the waveform "expansion rate" in the case of "slow" reproduction based on the waveform expansion process is determined by the setting of the "speech speed setting switch" provided on the apparatus and that a "default value" determined (in the program) in advance is used as the waveform "reduction rate" in the case of "fast" reproduction based on the waveform reduction process.

Figure 27:
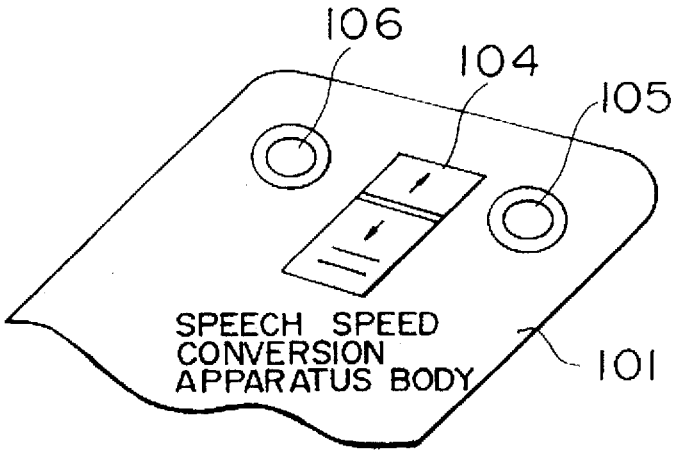
FIG. 27 is a typical view for explaining an accelerator type switch used in the continuous speech speed conversion means according to present invention.

The function of "making freely coming and going on the time axis of the speech possible" provided by this apparatus, however, can be used by the user more intuitively when an "accelerator type switch" shown in FIG. 27 is provided so that the waveform expansion/reduction rate is changed by this switch.

When the accelerator type switch is set to the center, the through mode in the aforementioned embodiments is executed. When the slide switch is pulled to the front, the waveform expansion process is employed so that "slow reproduction" is executed with a lag from the real time. When the slide switch is then pushed to the back, the waveform reduction process is employed reversely so that fat reproduction is executed (until the lag from the real time reaches zero).

During this, the controller changes the waveform expansion/reduction rate in accordance with the distance from the center of the slide switch. As is obvious from the explanation of the aforementioned embodiment of FIGS. 20 through 22, the expansion/reduction rate however can be set to no value but several values which can be expressed in integer rates. In practice, therefore, the expansion/reduction rate may be preferably set so that several stages of values can be selected in accordance with the distance from the center of the slide switch.

Further, when a lever is provided so that force acts to return the lever to the center automatically when the user releases the finger's hold of this accelerator type switch, it becomes easy for the user to keep the slide switch in another intermediate position than the center, so that an operating method easier to handle can be realized. Hereupon, the production of the force to return this lever to the center can be realized by two springs which are provided in the inside of a switching device to give thereto a mechanical means such as means of pulling the lever by uniform force from the opposite sides, and so on.

Figure 28:
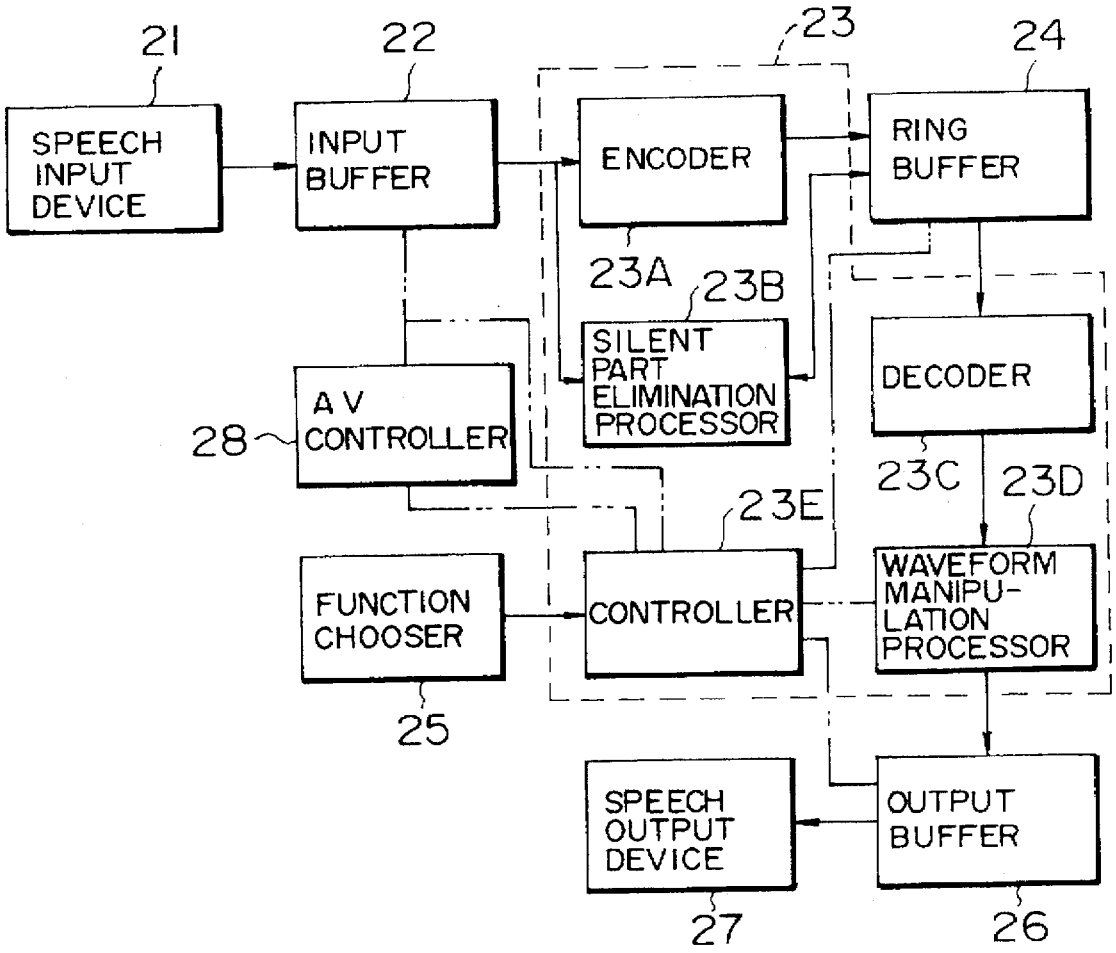
FIG. 28 is a block diagram showing the functional structure of the speech speed conversion apparatus provided with an AV control means according to present invention.
Figure 29:
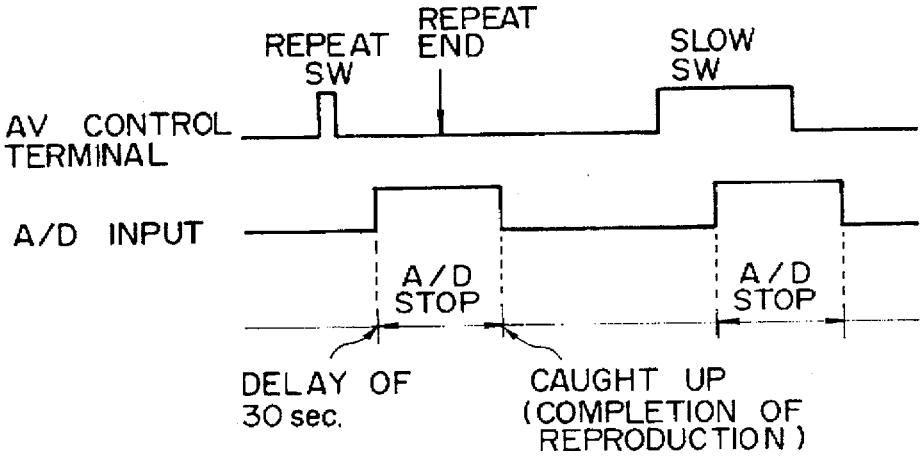
FIG. 29 is a view for explaining the operation of the AV control means according to present invention.
Figure 30:
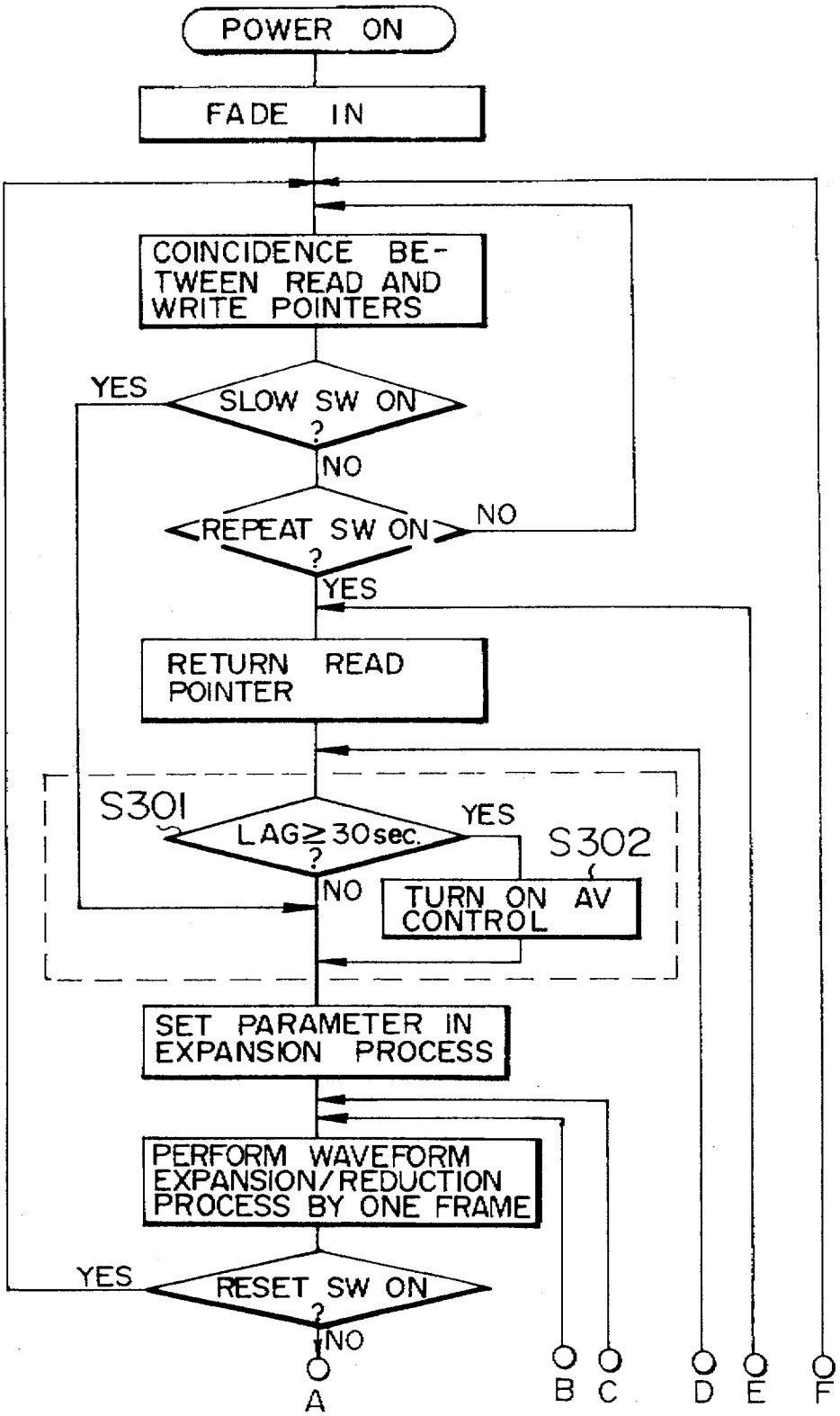
FIG. 30 is a flow chart showing the procedure of a main process in the speech speed conversion apparatus provided with the AV control means according to present invention.
Figure 31:
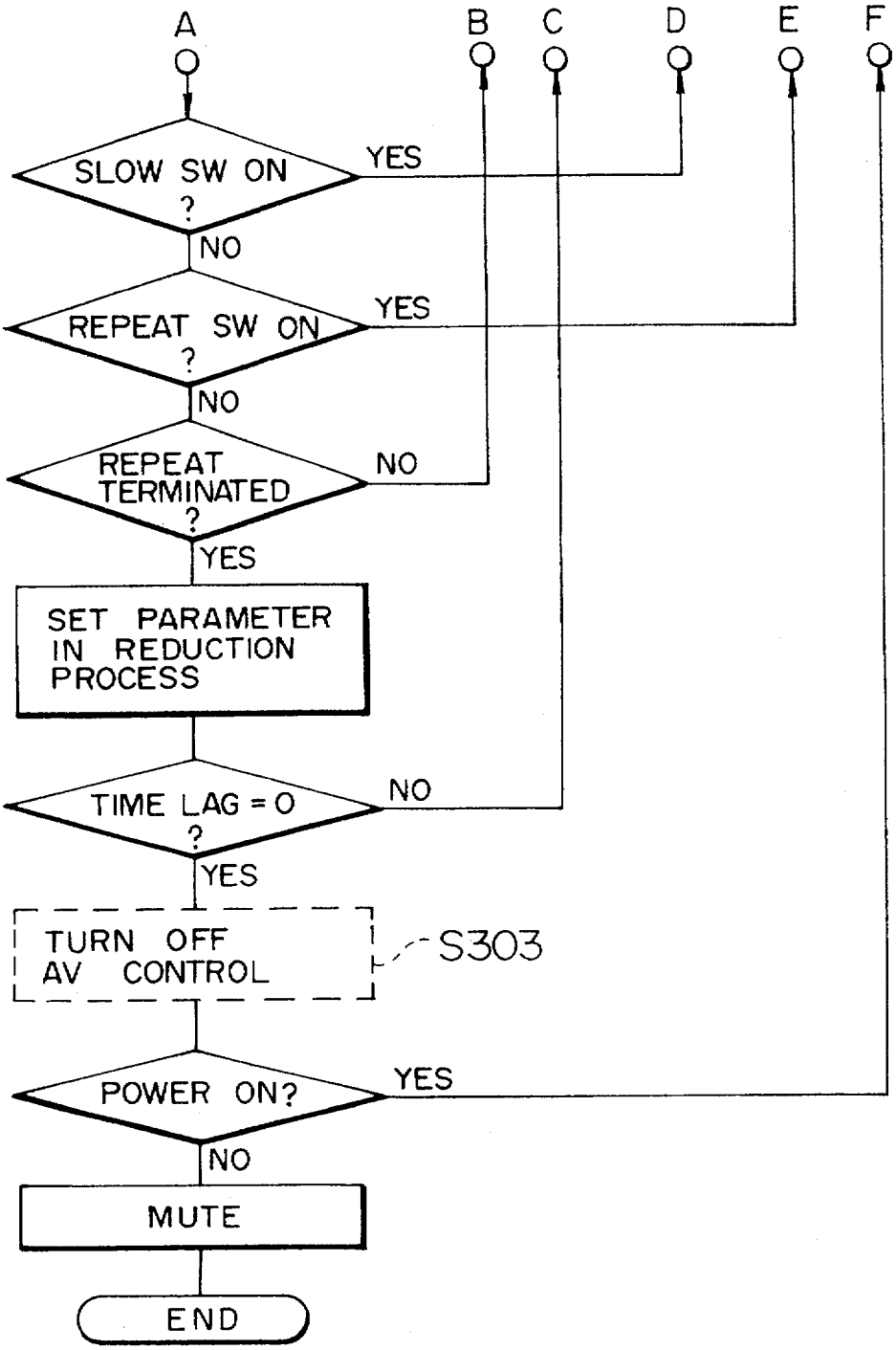
FIG. 31 is a flow chart to be continued from the flow chart of FIG. 30.

Referring next to FIG. 28, there is a block diagram showing the functional structure of a speech speed conversion apparatus provided with an AV control means. Referring to FIG. 29, there is a view for explaining the operation of the AV control means in this embodiment of FIG. 28. Referring to FIGS. 30 and 31, there are flow charts showing the operating procedure of the main process in the speech speed conversion apparatus provided with the AV control means in this embodiment.

As shown in FIG. 28, the speech speed conversion apparatus provided with the AV control means in this embodiment is provided as a functional structure in which an AV controller 28 is added to the functional structure of the speech speed conversion apparatus in the aforementioned embodiment shown in FIG. 11 and connected to the controller 23E.

The aforementioned controller 23E judges whether a condition for outputting an AV control signal is satisfied or not and operates the AV controller 28 to start/stop the outputting of the AV control signal.

As shown in FIG. 29, the AV control means is a software in which the AV control signal is outputted when the quantity of the lag from the real time as caused by slow or repeat reproduction exceeds a predetermined value (30 seconds in FIG. 29) and in which the outputting of the same signal is stopped when the lag quantity then reaches zero via catching-up reproduction.

The AV control signal is picked out of this apparatus and used for temporarily stopping the reproducing operation of a recording/reproducing apparatus such as a tape recorder, a video tape recorder, or the like. By this means, it is made possible to continue the slow hearing of an input voice which is continued for such a long time that exceeds the capacity of the ring buffer 24 in this apparatus.

In FIGS. 30 and 31, the portion surrounded by the broken line is a step showing the operating procedure of the AV control means added to the flow charts in FIGS. 12 and 13. In this step, a judgment is made as to whether the condition for outputting the AV control signal is satisfied or not (S301). The judgment with respect to the outputting of the AV control signal is realized by a judgment as to whether the quantity of the lag from the real time in a loop in which the one-frame waveform expansion/reduction process is repeated for slow or repeat reproduction is over 30 seconds or not (S301) and by starting the outputting of the AV control signal when the lag from the real time is over 30 seconds (S302).

On the other hand, the process of stopping the AV control signal is carried out just after the judgment "lag quantity= 0?" which is a judgment for escape out of the loop of the catching-up reproduction process (S303).

Figure 32A:
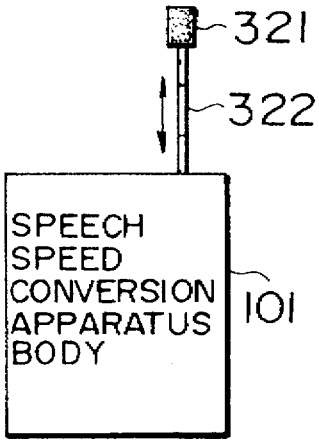
FIGS. 32A to 32C are views for explaining the arrangement of the microphone in the speech speed conversion apparatus according to present invention.
Figure 32B:
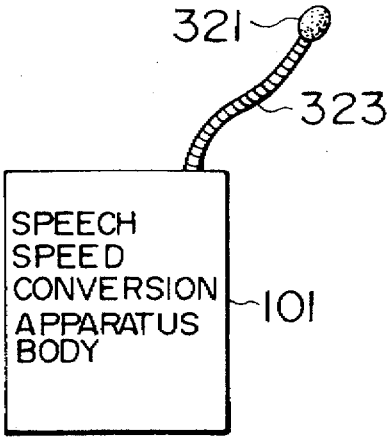
Figure 32C:
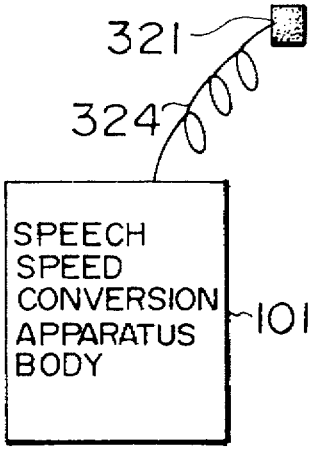

Referring next to FIGS. 32A, 32B and 32C, there are views for explaining the arrangement of a microphone in a speech speed conversion apparatus according to the present invention. The reference numeral 101 designates a body of the speech speed conversion apparatus; 321, a microphone;

moment that the hold of the slow switch (slow pushbutton) is released (S199). Specifically, a branching process for forcedly returning back to the through mode is carried out in this portion.

When the catching-up mode (Mcat) switch is set to "one-fold", the reduction rate s is set to one-fold (S200) and the situation of the routine goes to step 202.

When the catching-up mode (Mcat) switch is not set to "one-fold", the reduction rate s is set through the center flow in FIG. 19 at the time of the catching-up mode (S201), the values of parameters Npf and Npr used in the waveform reduction process are set in accordance with the reduction rate s (S202) and, further, parameter Ptri indicating the position from which weighted summation with respect to the Δ window as carried out in the waveform reduction process is started is set (S203), whereafter this routine is terminated.

FIGS. 23 and 24 are flow charts showing the procedure of the total operation of a speech speed conversion apparatus provided with a continuous speech speed conversion means according to the present invention.

As shown in this embodiment of FIGS. 23 and 24, continuous speech speed conversion in the speech speed conversion apparatus provided with the continuous speech speed conversion means is substantially an operation in which the pushing of the slow switch (slow pushbutton) 104 is continued so that slow reproduction is continued. The time lag is however accumulated rapidly when waveform expansion at a constant waveform expansion rate is continued, so that the quantity of the lag from the real time finally exceeds the capacity of the ring buffer 24 to make it impossible to continue slow hearing any more.

The continuous speech speed conversion means is therefore provided to mix a waveform expansion period and a waveform reduction period reverse thereto at the time of slow reproduction so that the lag from the real time is not increased rapidly.

Although several methods are considered as means for changeover to the continuous speech speed conversion mode, it is rather easy to understand that a clear distinction is made between the case where the pushing of the slow switch is continued simply for a considerably long time and the case where entry into the continuous speech speed conversion mode is intended. Accordingly, this changeover is realized, for example, by using switching parts by which the slow switch is locked when double-clicked (pushed twice at a short time interval) or when slid laterally while pushed.

The respective steps in the flow charts shown in FIGS. 23 and 24 in this embodiment are quite the same as in the procedure of the main process described above with reference to FIGS. 13 and 14.

In the continuous speech speed conversion means in this embodiment, whether the continuous speech speed conversion process is intended or not is checked in step S231 in FIGS. 23 and 24 (S231). If the continuous speech speed conversion process is intended (the case of Yes in S231), the one-frame waveform expansion/reduction process is carried out (S232). Then, a judgment is made as to whether the reset switch 106 is pushed (turned on) or not (S233). In the case where the reset switch 106 is not pushed (turned off), counting up by one frame is performed (S234) and a judgment is made as to whether the expansion period is intended or not (S235). If the expansion period is intended (the case of Yes in S235), the situation of the routine goes back to the step S232. If the expansion period is not intended (the case of No in S235), parameter is set for the reduction process (S236). Then, whether the lag quantity is zero or not is checked (S237). In the case where the lag quantity is zero (the case of Yes in S237), the situation of the routine goes back to the step S232. In the case where the lag quantity is not zero (the case of No in S237), parameter is set for the expansion process (S238) and the frame counter is reset (S239) whereafter the situation of the routine goes back to the step S232 so that the continuous speech speed conversion operation is repeated. In the case where the continuous speech speed conversion process is not intended in the aforementioned step S231 (the case of No in S231), the mode is shifted to the aforementioned main process routine (through mode).

That is, the continuous speech speed conversion means in this embodiment is a method in which slow reproduction and catching-up reproduction are repeated alternately at intervals of a preliminarily set time. According to this method, catching up to the real time at intervals of a predetermined time is always made possible. The management of the changeover between waveform expansion and waveform reduction is performed on the basis of the count of the number of frames. For example, when the expansion process for a number of frames corresponding to about five seconds is completed, the reduction process is then carried out repeatedly, and when the lag quantity reaches zero, the frame count is returned to zero and the expansion process is repeated again.

Further, escape out of the continuous speech speed conversion mode is achieved by the pushing-down of the reset switch 106 to return the mode to the through mode.

Figure 25:
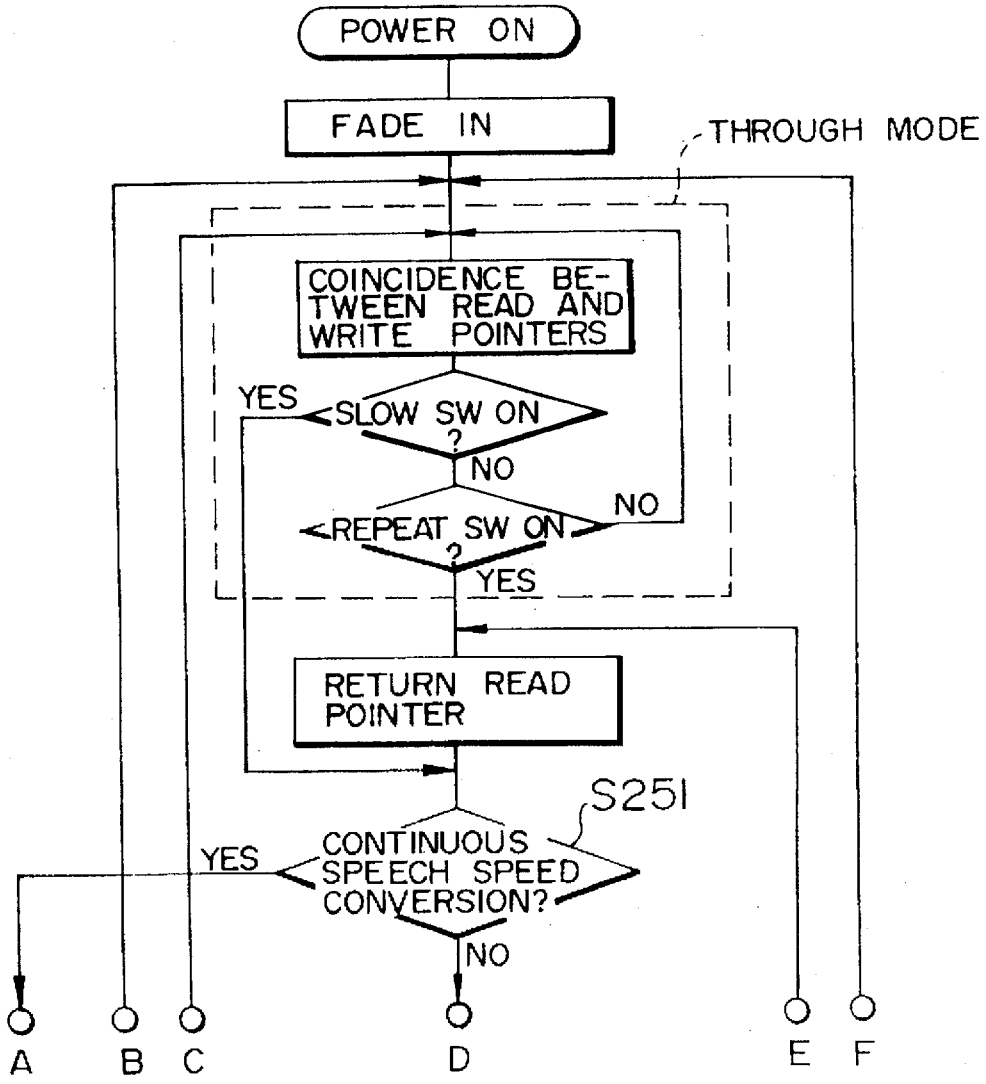
FIG. 25 is a flow chart showing the procedure of the total operation of the speech speed conversion apparatus provided with a continuous speech speed conversion means according to present invention.
Figure 26:
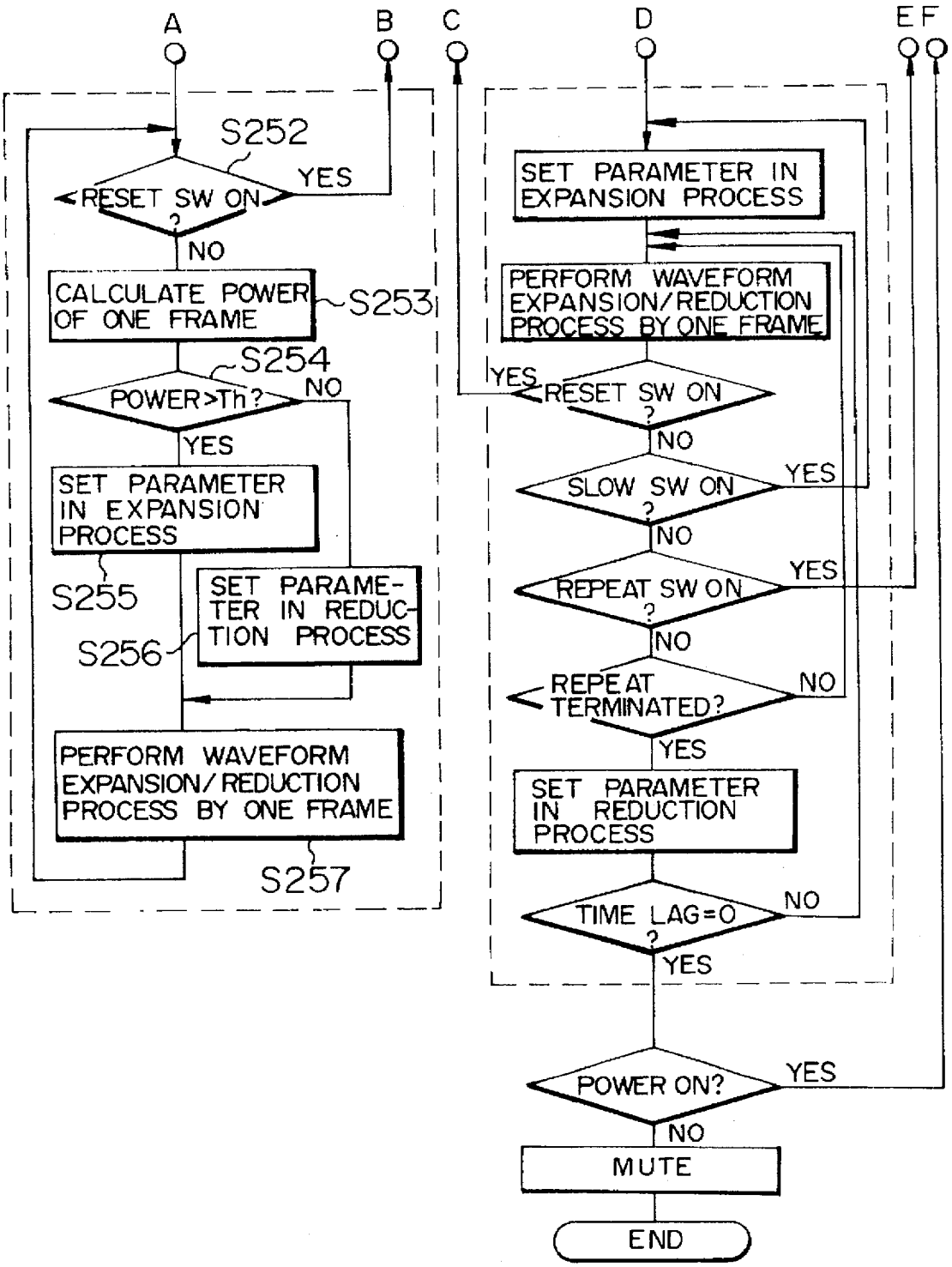
FIG. 26 is a flow chart to be continued from the flow chart of FIG. 25.

Referring next to FIGS. 25 and 26, there are flow charts showing the procedure of the total operation of a speech speed conversion apparatus provided with a continuous speech speed conversion means different from that in the embodiment shown in FIGS. 23 and 24.

The continuous speech speed conversion in the speech speed conversion apparatus provided with the continuous speech speed conversion means in this embodiment is an operation for applying waveform expansion to a frame of high power and applying waveform reduction to a frame of low power.

In the continuous speech speed conversion means in this embodiment, whether the continuous speech speed conversion process is intended or not is checked in step S251 in FIGS. 25 and 26. If the continuous speech speed conversion process is intended (the case of Yes in S251), a judgment is made as to whether the reset switch 106 is pushed (turned on) or not (S252). In the case where the reset switch 106 is not pushed (turned off), one-frame power is calculated (S253). Then, whether the calculated one-frame power is higher than the threshold Th or not is checked (S254). In the case where the calculated one-frame power is lower than the threshold Th (the case of No in S251), parameter is set for the reduction process (S256) and the situation of the routine goes to step S257. In the case where the calculated one-frame power is higher than the threshold Th (the case of Yes in S254), parameter is set for the expansion process (S255) and the one-frame waveform expansion/reduction process is carried out (S257) whereafter the situation of the routine goes back to the step S252 so that the continuous speech speed conversion operation is repeated. In the case where the continuous speech speed conversion process is not intended in the aforementioned step S251 (the case of No in S251), the mode goes to the aforementioned main process routine (through mode).

That is, when entry into the continuous speech speed conversion mode is made, one-frame power is calculated so that either expansion or reduction is applied to each frame on 322, a prop capable of expansion and contraction for supporting the microphone 321; 323, a flexible prop for supporting the microphone 321; and 324, an electric cord for electrically connecting the microphone 321 to the speech speed conversion apparatus body 101 by wire.

Figure 33:
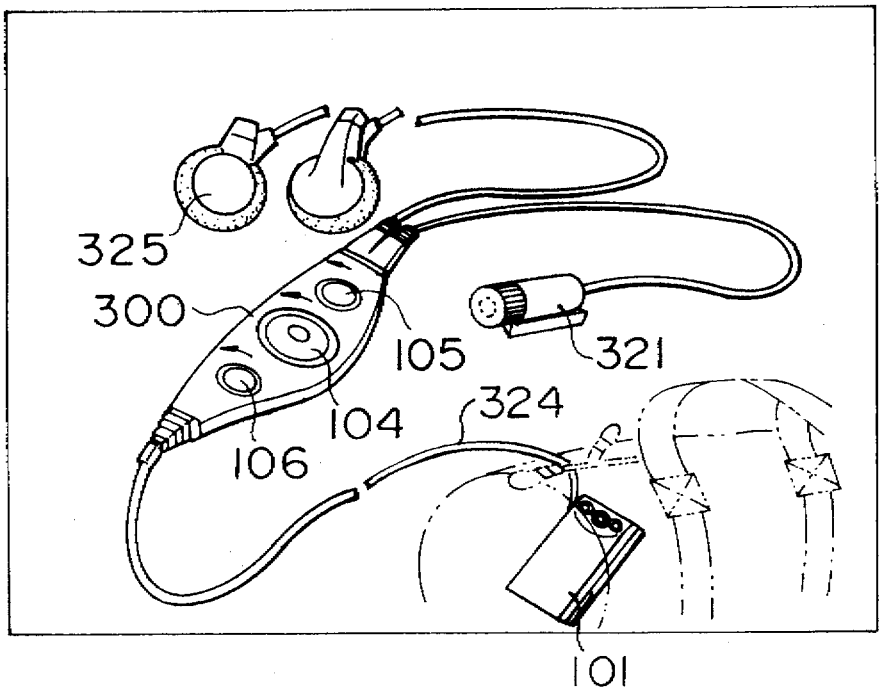
FIG. 33 is a view showing the structure of a modified example according to present invention.

FIG. 33 is a view showing a modified example of this embodiment of FIG. 32, in which the reference numeral 101 designates a body of the speech speed conversion apparatus; 104 a slow switch; 105, a repeat switch; 106, a reset switch; 321, a microphone; 324, an electric cord for electrically connecting the microphone 321 to the speech speed conversion apparatus body 101; 325, an earphone; and 300, a connection member.

In the arrangement of the microphone in the speech speed conversion apparatus of this embodiment, as shown in FIG. 32A, the microphone 321 is supported by the prop 322 capable of expansion and contraction. Because the aforementioned supporting of the microphone 321 makes the microphone 321 far away from the speech speed conversion apparatus body 101, the rustle of clothes can be prevented from being produced when the apparatus body is put into a breast pocket in use.

Alternatively, as shown in FIG. 32B, the microphone 321 is supported by the flexible prop 323. Being supported by such a manner, the microphone 321 is separated from the speech speed conversion apparatus body 101, and can be bent in a desired direction. Accordingly, the rustle of clothes can be prevented from being produced when the apparatus body is put into a breast pocket in use.

Further, as shown in FIG. 32B, the microphone 321 and the speech speed conversion apparatus body 101 are electrically connected to each other by wire (or wireless). The S/N ratio can be improved because the microphone 321 and the speech speed conversion apparatus body 101 are electrically connected to each other by wire (or wireless) as described above so that the microphone 321 is disposed near the listener independently of the speech speed conversion apparatus body 101.

Further, as shown in FIG. 33, the speech speed conversion apparatus body 101 and the microphone 321 are electrically connected to each other by the electric cord through the earphone 325 and the connection member 300. Further, operation switches such as the slow switch 104, the repeat switch 105, the reset switch 106, and so on, are provided on the aforementioned connection member 300. In this manner, not only the rustle of clothes can be prevented from being produced when the apparatus body is put into a breast pocket in use but also both the S/N ratio and the handling property can be improved.

Figure 34:
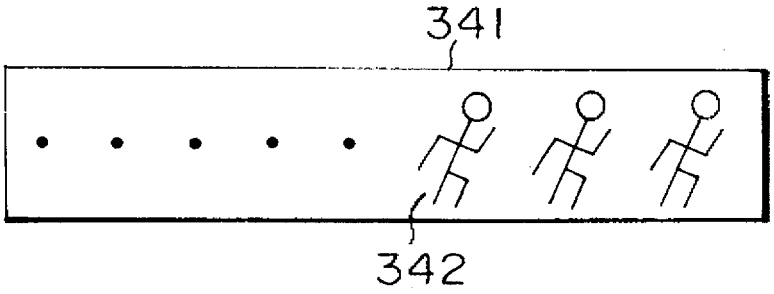
FIG. 34 is a view for explaining a lag time display means in the speech speed conversion apparatus according to present invention.

Referring next to FIG. 34, there is a view for explaining a lag time display means in a speech speed conversion apparatus according to a further embodiment of the present invention. The reference numeral 341 designates a display portion; and 342, a display screen.

As shown in FIG. 34, the lag time display means in this embodiment displays how much the speech of a speaker is delayed from the real speech speed at the time of the aforementioned slow/repeat reproduction. For example, assuming that one human image represents the time lag of 10 seconds in FIG. 34, then the time lag from the current time is expressed in the number of displayed human images. In this manner, the quantity of time lag from the current time is recognized visually. Accordingly, both speaker and listener can adjust the speech speed conversion easily, so that this apparatus can be used so as to be easy to handle.

The visual display of the time lag is realized, for example, by the provision of a liquid crystal display in the front center of the speech speed conversion apparatus body shown in FIG. 6 and by the display of the display screen as shown in FIG. 34 on the liquid crystal display. Further, this display portion is controlled by a "liquid crystal display driver" (not shown) connected to the controller 23E in FIG. 11.

Because the quantity of the time lag to be displayed is continuously managed by the lag quantity counter in the main process shown in FIGS. 13 and 14, the numerical value of this lag quantity counter can be converted at the conversion rate of one to 10 seconds so that a corresponding number of human images can be indicated on the aforementioned display. This displaying operation is carried out by the controller 23E in FIG. 11 through the aforementioned display driver and the timing of rewriting the display is sufficient as long as the rewriting is performed whenever the processing of one frame is completed. For example, this displaying process is carried out between the steps S137 and S138 in FIG. 14.

Figure 35:
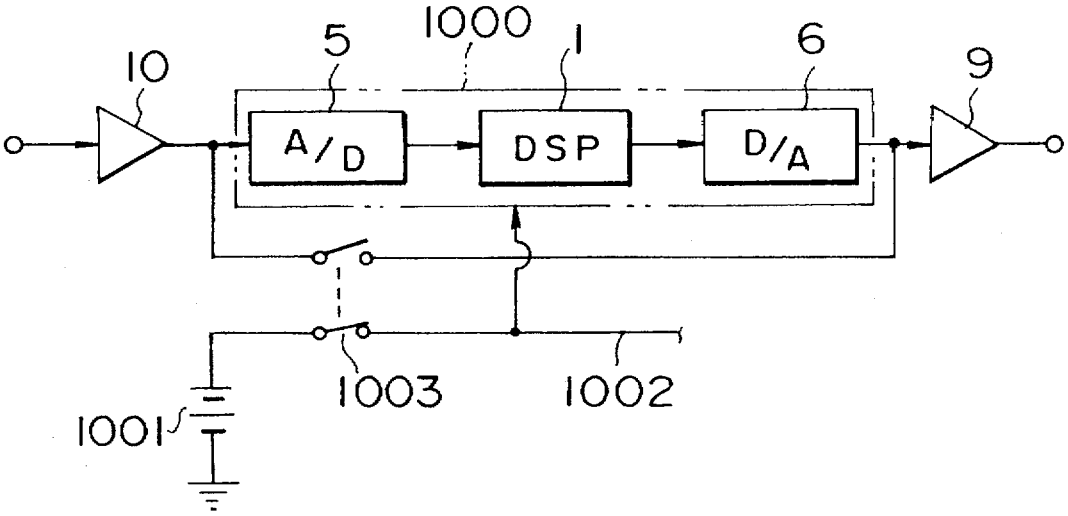
FIG. 35 is a diagram for explaining an electric source device in the speech speed conversion apparatus according to present invention.

Referring to FIG. 35, there is a view for explaining an electric source device in a speech speed conversion apparatus according to the present invention. The reference numeral 1000 designates an apparatus portion concerning the speech speed conversion apparatus; 1, a DSP; 5, an A/D converter; 6, a D/A converter; 9, an analog amplifier; 10, an analog amplifier; 1001, an electric source; 1002, an electric power supply line; and 1003, a changeover switch.

In the speech speed conversion apparatus in this embodiment, as shown in the state transition view of FIG. 15, a standby mode is provided besides the through mode so that entry into the standby mode is made automatically when the through mode is continued for a predetermined time. That is, when either slow switch or repeat switch is pushed (turned on), clock frequency is heightened so that each process is carried out.

Further, in the through mode, the DSP 1 operates with fast clock but power is wasteful because the speech speed conversion process or the like is not executed. In the standby mode, therefore, the operating clock for the DSP 1 is lowered so that only I/O of data is performed to thereby reduce consumed electric power. Further, only storage into the memory is performed. In this manner, a voice memory function is realized.

Further, as shown in FIG. 35, at the time of an analog through mode, the changeover switch 1003 is connected to a contact side to cut off the electric power supply line 1002 and also connected to a contact side to connect the analog amplifiers 10 and 9 directly so that electric power is not supplied to the DSP 1, the A/D converter 5, the D/A converter 6 and peripheral digital circuits. At this time, the storage into the memory is not performed. That is, I/O analog systems are connected directly so as to be operated simply as an analog amplifier. The aforementioned changeover switch is provided as a switch of three stages, namely, an ON stage, an OFF stage and an ON-OFF intermediate stage as shown in FIG. 35, so that the analog through mode is provided.

As is obvious from the above explanation, in accordance with this embodiment, a switch of three stage consisting of an ON stage, an OFF stage and an ON-OFF intermediate stage is formed so that the analog through mode is provided. Accordingly, not only reduction in electric power can be attained but also the range of use of the electric source can be widened.

Figure 36:
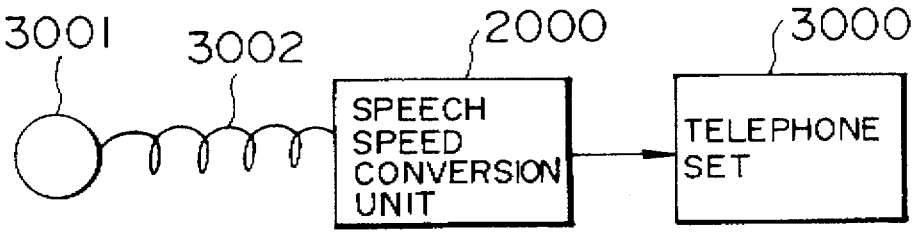
FIG. 36 is a diagram for explaining an embodiment in which the speech speed conversion means according to the present invention is applied to a telephone.

Referring to FIG. 36, an embodiment in which the speech speed conversion means according to the present invention is applied to a telephone will be described. The reference numeral 2000 designates the speech speed conversion means according to the present invention; 3000, a body of the telephone; 3001, a transceiver; and 3002, a telephone line.

As shown in FIG. 36, the telephone in this embodiment is formed by inserting the speech speed conversion means 2000 according to the present invention between the handset 3001 and the telephone body 3000. The speech speed conversion means 2000 is, for example, shaped like a mount on which the telephone body 3000 is put.

Further, in the case of a cordless handset or cordless child transceiver 3001, the speech speed conversion means 2000 is inserted between the transceiver 3001 and the telephone body 3000 by wireless.

Further, the speech speed conversion means according to the present invention may be used as a speech speed conversion means in a switching system so that it can be operated at the user's request.

In the aforementioned structure, a voice can be heard over the telephone slowly. Further, because the voice is fed back as a through voice to the speaker side as well as the voice can be heard slowly to the listener so that the speaker can speak ordinarily at the time of telephone conversation with the aged or the like, there is no fear of hard speaking.

Further, it is unnecessary that any A/D means is provided in the inside of the speech speed conversion means as long as the speech speed conversion means is provided as a digital circuit.

Figure 37:
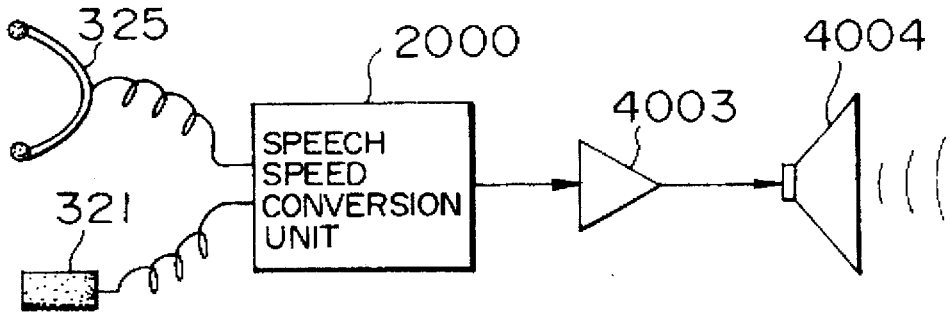
FIG. 37 is a diagram for explaining an embodiment in which the speech speed conversion means according to the present invention is applied to a premises broadcasting system.

Referring to FIG. 37, description will be made as to an embodiment in which the speech speed conversion means according to the present invention is applied to a premises broadcasting system. The reference numeral 2000 designates the speech speed conversion means; 321, a microphone; 325, an earphone; 4003, an amplifier; and 4004, a speaker.

In the telephone in this embodiment, as shown in FIG. 37, the speech speed conversion means 200 according to the present invention is inserted between the microphone 321, the earphone 325 and the amplifier 4003 for the speaker 4004.

In the aforementioned structure, the listener can hear a voice at a suitable speech speed even in the case where the speaking person does not control the speech speed conversion operation. For example, even in the case where the speaking person talks volubly at a high speech speed (impetuous speed) selfishly, the listener can hear at a suitable speech speed.

Further, the listener can hear at a suitable speech speed from a speaker even in the case where a speaking person speaks slowly.

As is obvious from the above explanation, the present invention can be applied to technical fields requiring speech speed conversion, such as for example hearing aids, learning of languages, abroad traveling, music, and so on, besides telephones, telephone line switching systems and premises broadcasting.

For example, in goods for learning of languages and for abroad traveling, the present invention can be applied to the following cases.

(1) A voice recorded is heard continuously and slowly.
(2) The expansion rate is changed in accordance with the improvement in level.
(3) A portion which was hard to understand when heard at an ordinary speed is heard repeatedly and slowly.
(4) After heard slowly, a voice is heard again at its original speed.
(5) After slow repeat, pronounce is imitated.
(6) An imitated voice is heard in comparison with its original voice.
(7) A plurality of persons hear one source simultaneously at their favorite speech speeds.

Further, in combination with a digital audio apparatus such as a tape recorder, a CD recorder, an MD recorder, and so on, it is unnecessary that any A/D converter is provided in the speech speed conversion apparatus as long as the audio apparatus has a digital output.

Further, in the music purpose, the present invention can be applied as long as changes are made as follows.

The judgment based on the power of an expanded frame is not carried out (because tempo is disordered).

The pitch extraction range is widened compared with the case of a voice.

The waveform expansion process is carried out on the basis of the pitch of a fixed length. In the case of a voice thereof, the pitch is detected so that processing is made on the basis of the detected pitch.

A foot switch is provided so that a converting operation can be carried out by the foot switch. This makes it possible to control a music instrument while playing.

Although the present invention has been described specifically on the basis of the embodiments thereof, it is a matter of course that the present invention is not limited to the aforementioned embodiments and that various changes may be made without departing from the spirit thereof.

In brief, effects obtained by typical embodiments of the present invention disclosed in this application are as follows.

(1) Because the speech speed conversion apparatus can be used not only for a voice one-sidedly given to the listener such as a radio voice but also in the situation of conversation, a voice to be subjected to speech speed conversion can be selected by the listener without any disturbance of listener's own speech.

Further, in hearing aids, foreign language learning machines, telephones, and so on, talker's voice can be heard at a slow speech speed without any change of the characteristic of the voice.

(2) Effective use of the memory, a raw voice repeat function, a voice memory function, a repeat voice speech speed conversion function, a fast-hearing reproduction function, and so on, can be provided.
(3) Because means for changing the speech speed to a value selected by the speech speed selection switch is provided, the speech speed of a voice to be heard can be selected by the listener's own will.
(4) Because means for repeating a reproduced voice in a period in which the repeat switch is turned on is provided, the speech speed of the repeat voice can be converted.
(5) Because a catching-up means for catching up to a position of stored information to be heard is provided in the speech speed conversion apparatus, widening of the range of application of the speech speed conversion apparatus, reduction in operating time, improvement in handling property, and so on, can be attained.
(6) Because at least one of the speech speed conversion switch, the speech speed selection switch, the repeat switch and the reset switch is provided in a peripheral portion which is on a side surface of the speech speed conversion apparatus and easy to handle, widening of the range of application of the speech speed conversion apparatus, reduction in operating time, improvement in handling property, and so on, can be attained.
(7) Efficiency in the speech speed conversion process can be improved.
(8) Because not only the determination of the waveform expansion/reduction process and of the silent-part elimination process in the speech speed conversion process is made on the basis of comparison between the power of a frame and the threshold but also the threshold is changed in accordance with the loudness of the input voice, the speech speed conversion process can be carried out in accordance with the environmental condition in use.

(9) Because the microphone does not catch click noise of switches, the reproduced voice can be heard accurately.

(10) Because the switches have respective surface forms which are different in tactility so as to be identified without seeing, handling property can be improved.

(11) Because means for preventing the rustle of clothes against the microphone is provided, the entrance of noise can be reduced.

(12) Because display means capable of visually indicating the quantity of a time lag from the current time is provided in a predetermined position of the speech speed conversion apparatus, reduction in operating time, improvement in handling property, and so on, can be attained.

(13) Because a ring buffer is used as a memory means so that means for managing the lag time by a counter indicating the time lag on the ring buffer is provided, complex calculation of pointer addresses in the repeat process, the catching-up process, and so on, can be performed easily.

(14) Because a standby mode and an analog through mode are provided besides the through mode, reduction in consumed electric power can be attained.

(15) Because the electric source switch is provided in the form of three stages consisting of an stage, an stage and an OFF intermediate stage so that the analog through mode is provided, not only reduction in electric power can be attained but also the range of use of the electric source can be widened.

(16) Because the aforementioned speech speed conversion means is provided between the handset of a telephone and the apparatus body, a voice to be subjected to speech speed conversion can be selected by the listener without any disturbance of the listener's own speech.

(17) A talker's voice over the telephone can be heard at a slow speech speed without any change of the characteristic of the voice.

(18) Because the speech speed conversion means is provided in a telephone line switching system, a voice to be subjected to speech speed conversion can be selected by the listener without any disturbance of the listener's own speech.

What is claimed is:

1. An audio signal storing apparatus having a function for converting speech speed, comprising:

audio signal input means for taking in an audio signal;

a memory for storing said audio signal;

an audio signal processing means for executing one of the following processing modes:

a through mode for storing the audio signal into said memory while the audio signal is read out from said memory without changing the audio signal speed, a repeat mode for reading out the audio signal stored in said memory in the past and for outputting the past audio signal read out from said memory without changing the audio signal speed, and a speech speed changing mode for executing a speech speed changing process for the audio signal read out from said memory;

switch means for causing said audio signal processing means to execute as said speech speed changing process one of said three processing modes of said audio signal processing means; and output means for outputting an output of said audio signal processing means as an audio signal.

2. An apparatus according to claim 1, further comprising:

means for controlling at least an audio signal derived from an audio/video apparatus coupled to said audio signal storing apparatus.

3. An apparatus according to claim 1, wherein, when said repeat mode is selected by said switch means, said audio signal is read out from a position where the audio signal had been recorded in the past by a predetermined time and outputted the read out audio signal.

4. An apparatus according to claim 1, wherein there are at least two speech speeds of an output audio signal in said repeat mode among a speed same as the input speed, a slow speed lower than the input speed, a fast speed higher than the input speed, and a gradually accelerated speed.

5. An apparatus according to claim 1, further comprising:

a catch-up mode for adjusting a quantity of a time lag from the input audio signal in real time so as to catch up with the real time audio signal when the time lag is caused by the repeat mode or the speech speed changing mode.

6. An apparatus according to claim 5, wherein said catch-up mode starts during execution of said repeat mode or said speech speed changing mode, and is changed to said through mode when the output audio signal catches up to the real time input audio signal.

7. An apparatus according to claim 6, wherein a message signal is outputted when the output audio signal catches up to the real time input audio signal.

8. An apparatus according to claim 5, wherein each of said means forming said apparatus is disposed on a surface of a body of said apparatus or at an inside location of said body, said apparatus has, as said switch means, a repeat switch for instructing said repeat mode, a speech speed change mode switch for instructing said speech speed change mode, and a reset switch for cancelling speech speed change mode and transferring to said through mode, said switches being disposed at a easy-to-use place on a periphery of a side of said body.

9. An apparatus according to claim 8, wherein said audio signal input means is disposed on a top portion of said body so as to prevent said audio signal input means from directly touching clothes when said apparatus body is put into a pocket while in use.

10. An apparatus according to claim 5, wherein, when said reset switch is turned on during said catch-up mode, the catch up mode is transferred to said through mode.

11. An apparatus according to claim 5, wherein said catchup mode is started during execution of said repeat mode or said speech speed changing mode, and is transferred to said through mode when the audio signal is reproduced by the repeat mode indication time point.

12. An apparatus according to claim 1, further comprising:

means for hearing said audio signal from said output means through a binaural headphone.

13. An apparatus according to claim 1, wherein each of said switches is formed with a switch which has a feeling of soft touch so that said audio signal input means does not pick up a click noise of the switch.

14. An apparatus according to claim 1, wherein each of said means forming said apparatus are disposed on a surface of a body of said apparatus or at an inside location of said body, and said apparatus further comprises a rustling prevention means for preventing said audio signal input means from directly touching clothes when said apparatus body is put into a pocket while in use.

15. An apparatus according to claim 1, wherein each of said means forming said apparatus is disposed on a surface of a body of said apparatus or at an inside location of said body, and said apparatus further comprises a display means which is provided at a predetermined position of said apparatus to thereby visually indicate a quantity of time lag from the real time produced by execution of said repeat mode or said speech speed changing mode.

16. An apparatus according to claim 15, wherein a ring buffer is used as said memory means, and said apparatus further comprises means for managing a lag time by a counter which indicates a time lag on said ring counter, a result of said managing means being displayed by said display means.

17. An apparatus according to claim 1, wherein said audio signal processing means further executes a standby mode, wherein a clock cycle for executing the process is decreased and the same process as in the through mode is executed.

18. An apparatus according to claim 1, further comprising:

an electric source switch of an apparatus body operated at three stages consisting of an ON stage, and OFF stage and an ON-OFF intermediate stage, and an electric power supply means operated in an analog through mode in which analog input-output systems are short-circuited so as to be directly connected to each other to thereby stop electric power supply to a digital processing system between said analog input-output systems when said electric source switch is in the intermediate stage.

19. A telephone line switching system having said speech speed changing means as defined in claim 1.

20. An apparatus according to claim 1, wherein, in said through mode, the audio signal read out from said memory is outputted without changing not only the audio signal speed but also other characteristics of said audio signal.

21. An apparatus according to claim 1, wherein said audio signal processing means is controlled in such a manner that an intermittent sound is outputted until the audio signal stored in said memory in the past is read out from said repeat mode selected by said switch means.

22. An apparatus according to claim 1, wherein each of said means forming said apparatus is disposed on a surface of a body of said apparatus or at an inside of said body, said apparatus has, as said switch means, a repeat switch for instructing said repeat mode, a speech speed change mode switch for instructing said speech speed change mode, and a reset switch for cancelling said speech speed change mode and for transferring to said through mode, said switches being disposed at a easy-to-use place on a periphery of a side of said body.

23. An apparatus according to claim 22, wherein said switches have respective surface forms different in tactility so as to be identified without seeing.

24. An audio signal storing apparatus having a function for converting speech speed, comprising:

a microphone for converting an acoustic signal into an electric signal;

a first analog amplifier for amplifying an output of said microphone;

a first low-pass filter for removing high-frequency components from an output of said analog amplifier;

an A/D converter for converting an output of said analog amplifier into a digital signal;

a memory means for storing input speech data and data obtained as a result of signal processing;

a digital signal processor for reading out data from said memory means and for carrying out digital signal processing to execute a speech speed changing process for the acoustic signal in accordance with an external speech speed conversion instruction;

means for controlling said speech speed changing process executed by said digital signal processor;

means for changing a parameter of said speech speed changing process;

selecting means for receiving said speech speed conversion instruction and causing said digital signal processor to execute as said speech speed changing process one of the following processings:

a first processing for storing input speech data into said memory means while the speech data are read out from said memory means, and for outputting the speech data read out from said memory means without changing the speech speed, a second processing for reading out the speech data stored in said memory means in the past and for outputting the past speech data read out from said memory means without changing the speech speed, and a third processing for executing said speech speed changing process for the speech data read out from said memory means;

a D/A converter for converting digital speech data outputted from said digital signal processor into an analog speech signal;

a second low-pass filter for removing high-frequency components from outputs of said D/A converter;

a second analog amplifier for amplifying an output of said second low-pass filter; and a head-phone for converting an output of said second analog amplifier into an acoustic signal and for supplying the acoustic signal to ears of a user.

25. An apparatus according to claim 24, wherein said third processing is provided as a software executed by said digital signal processor having an input terminal for receiving an interruption request signal from the outside, so that an instruction for selection of one mode among said first to third processings by said selecting means is provided to said digital signal processor via the input terminal receiving said interruption request.

26. An audio signal storing apparatus having a function for converting speech speed, comprising:

audio signal input means for taking in an audio signal;

a ring buffer for storing said audio signal;

an audio signal processing means for executing one of the following processing modes:

a through mode for storing audio signal into said ring buffer while the audio signal is read out from said ring buffer and for outputting the audio signal read our from said ring buffer without changing the audio signal speed, a repeat mode for reading out the audio signal stored in said ring buffer in the past and for outputting the past audio signal read our from said ring buffer without changing the audio signal speed, and a speech speed changing mode for executing a speech speed changing process for the audio signal read out from said ring buffer;

wherein, in said speech speed changing mode, average power of said audio signal is calculated in each input frame unit, said speech speed changing process being executed only in a case where said average power is higher than a predetermined threshold value, and the audio signal of frame unit being directly outputted in a case where said average power is lower than said predetermined threshold value, said speech speed changing mode being executed as a pipeline process by each frame unit with use of a plurality of input frame buffers in such a manner that for data of every frame a pitch extraction process is applied to a leading portion of the frame to detect a pitch of the leading portion, data of a length of one pitch thus detected is transferred to output buffers, data of a length of two pitches is multiplied by a window function which changes from 0 to 1 and by a window function which changes from 1 to 0, respective data obtained by the multiplications by the window functions are added together to thereby generate a reproduced wave pattern having a time length of two pitches, the reproduced wave pattern being inserted in the rear of the preliminary transferred data of the length of one pitch, a pitch detection process is again carried out while spearheaded by a position preliminary subjected to the pitch extraction process to thereby perform pitch detection at said position, and data of the length of n pitches (n is an integer) based on the pitch length obtained by the final pitch detection to the output buffers;

a switch for causing said audio signal processing means to execute as said speech speed changing process one of said processing modes of the audio signal processing means; and output means for outputting an output of said audio signal processing means as an audio signal.

27. An apparatus according to claim 26, wherein said ring buffer stores the audio signal by each frame unit.

28. An apparatus according to claim 26, wherein determining of waveform expansion/reduction processes in said speech speed changing process is made by referring to results of comparison between power of frame and a threshold value which is externally adjustable.

29. An apparatus according to claim 26, wherein a second threshold value is provided in the comparison process for comparing said average power with the predetermined threshold value so that when a frame having lower average power than said second threshold value is continued for a longer time than a predetermined time threshold, data in the frame having lower average power than the second threshold value and continued for a longer time than said time threshold are forbidden to be transferred to the output buffers.

30. A speech speed conversion apparatus for receiving an input speech and for changing output time without changing a pitch of said input speech, comprising:

a portable case having a speech input microphone disposed on a surface of the case, an output control switch, and a speech output terminal, said case being as small as a palm;

said case includes:

compressing means coupled to said input microphone for digitally compressing said input speech in each predetermined length, said compressing of the input speech being deleting of data bit, wherein a speech power is smaller than a first threshold value and the period is longer than a predetermined time length, a memory for storing the compressed speech data in an order of time series, decompressing means for reading out the compressed speech data of the predetermined length from said memory and for releasing said compressed speech data from the compression, speech speed converting means for outputting the decoded speech data in response to an instruction from said output control switch and for converting the speed of said speech data in such a manner that the decompressed speech data, in a period where the power of speech data is larger than a second threshold value, is maintained in constant pitch and the time axis is extended longer than the input time of said period; and output means for supplying an output from said speech speed converting means to said speech output terminal.

31. An audio signal storing apparatus having a function for converting speech speed, comprising:

audio signal input means for taking in an audio signal;

a memory for digitizing said audio signal and storing the digitized audio signal in accordance with a writing pointer;

an audio signal processing means for executing one of the following processing modes for the audio signal read out from a reading pointer position of said memory:

a through mode for outputting a read-out audio signal from said memory in such a manner that a reading pointer position is same as a writing pointer position, a repeat mode for outputting the audio signal read out from said memory by setting the reading pointer position which is returned back by a predetermined time from the writing pointer, and a speech speed changing mode for outputting the audio signal by executing a speech speed changing process for the audio signal read out from said memory in such a manner that the reading pointer position is gradually delayed from the writing pointer;

switch for causing said audio signal processing means to execute as said speech speed changing process one of said three processing modes of said audio signal processing means; and output means for converting the output of said audio signal processing means to an analog signal and outputting said analog signal as an audio signal.

32. An apparatus according to claim 31, wherein the reading pointer position and the writing pointer position are same with each other at a start point of said speech speed changing mode.

33. An apparatus according to claim 31, wherein the reading pointer position is delayed in time from the writing pointer position at a start point of said speech speed changing mode.

34. An apparatus according to claim 31, wherein a time span between the reading pointer position and the writing pointer position is constant in said repeat mode.

* * * * *